US007323282B2

(12) United States Patent
Ohno et al.

(10) Patent No.: US 7,323,282 B2
(45) Date of Patent: Jan. 29, 2008

(54) DRY TONER, METHOD FOR PRODUCING DRY TONER, AND METHOD FOR FORMING AN IMAGE

(75) Inventors: Manabu Ohno, Shizuoka-ken (JP); Motoya Fukushima, Shizuoka-ken (JP); Hitoshi Itabashi, Kanagawa-ken (JP); Yasushi Katsuta, Shizuoka-ken (JP); Emi Tosaka, Shizuoka-ken (JP); Norikazu Fujimoto, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/758,466

(22) Filed: Jun. 5, 2007

(65) Prior Publication Data

US 2007/0231729 A1 Oct. 4, 2007

Related U.S. Application Data

(62) Division of application No. 10/796,091, filed on Mar. 10, 2004, now Pat. No. 7,252,917.

(30) Foreign Application Priority Data

Mar. 10, 2003 (JP) ..... 2003-063893

(51) Int. Cl.
*G03G 15/20* (2006.01)

(52) U.S. Cl. ..... 430/124.34; 430/108.24

(58) Field of Classification Search ..... 430/124.34, 430/108.24
See application file for complete search history.

(56) References Cited

U.S. PATENT DOCUMENTS

| | | | | |
|---|---|---|---|---|
| 5,766,814 | A | 6/1998 | Baba et al. | 430/106.6 |
| 6,124,070 | A | 9/2000 | Baba et al. | 430/109 |
| 6,342,328 | B1 | 1/2002 | Takasaki et al. | 430/108.22 |
| 6,689,525 | B2 | 2/2004 | Itabashi | 430/108.22 |
| 6,806,016 | B2 * | 10/2004 | Ohno et al. | 430/125.3 |
| 6,855,471 | B2 * | 2/2005 | Katsuta et al. | 430/108.23 |

FOREIGN PATENT DOCUMENTS

| | | |
|---|---|---|
| JP | 05-70511 | 3/1993 |
| JP | 11-327208 | 11/1999 |
| JP | 2000-352844 | 12/2000 |

* cited by examiner

*Primary Examiner*—John L Goodrow
(74) *Attorney, Agent, or Firm*—Fitzpatrick, Cella, Harper & Scinto

(57) ABSTRACT

The toner having a significantly improved dispersibility of a colorant in toner particles is provided. The present invention provides a dry toner comprising: (i) a binder resin; (ii) a colorant; (iii) at least one of metallophthalocyanine and a metallophthalocyanine derivative having a central metal selected from the group consisting of Cr, Fe, Co, Ni, Zn, Mn, Mg, and Al; and (iv) a polymer containing 0.5 to 20% by mass of a base unit derived from a specific polymerizable monomer having an amide group.

6 Claims, 7 Drawing Sheets

DRY TONER, METHOD FOR PRODUCING DRY TONER, AND METHOD FOR FORMING AN IMAGE

BACKGROUND OF THE INVENTION

1. Field of the Invention

The present invention relates to a dry toner employed in recording methods utilizing electrophotography, electrostatic recording, electrostatic printing, magnetic recording, a toner jet method, or the like, a method for producing the dry toner, and a method for forming an image. The present invention more specifically relates to a dry toner employed in an image forming apparatus which may be used for a copier, a printer, a facsimile, a plotter, or the like, a method for producing the dry toner, and a method for forming an image.

2. Description of the Related Art

Electrophotography providing a fixed image usually involves: forming an electrical latent image on a photosensitive member through various means; subsequently developing the latent image using a toner; transferring a toner image to a transfer material such as paper as appropriate; and fixing the toner image through heating, pressing, heat pressing, or solvent vapor.

A dry toner employed for the electrophotography (hereinafter, referred to as "toner") usually consists of colored resin fine particles containing a binder resin, a colorant, and waxes as main components. The colored resin fine particles generally have particle diameters of about 6 to 15 μm with respect to number-average particle diameter. A method for producing the toner consisting of such colored resin fine particles generally involves: melt-kneading the binder resin, the waxes, the colorant such as pigments, dyes, and/or magnetic materials, or the like; cooling the kneaded product; pulverizing the cooled product; and then classifying the pulverized product to provide toner particles(this method is called "pulverization process"). However, according to the pulverization process, size reduction of the toner particles to fine particles or shape control of the toner particles not only provokes reduction in productivity, and further there is a limit to actively designing an inner structure of the toner particles. On the other hand, the production of the toner through "polymerization process" has been carried out for overcoming problems of the toner production through pulverization process, and in addition, for further achieving an improvement of toner performance through functionalization of the toner to higher levels. To be specific, the polymerization process is roughly divided into suspension polymerization process and emulsion aggregation process.

Recently, application fields of an image forming apparatus utilizing the electrophotography have rapidly developed with increased wide variety of demands not only as a copier for simply copying an original, but also as a printer which is an output device of a computer and as a personal copy, further as a plain paper facsimile or the like. Further, the functionalization of the copier to higher levels through digitalization has progressed. In particular, miniaturization of an image forming apparatus unit, speeding up, and colorization are significantly progressing, and further, high reliability and high resolution are strongly demanded. For example, a resolution, which was initially 200 to 300 dots per inch (dpi), is now 400 to 1,200 dpi, further increasing to 2,400 dpi. Further, according to full-color image forming, a multi-color image is generally reproduced by: repeating development and transfer of an electrostatic latent image using a magenta toner, a cyan toner, a yellow toner, and a black toner; superimposing toner images of respective colors; and fixing the superimposed images. Such a high resolution and/or full-color image forming apparatus have been designed with simpler components using members with various functions of high levels for satisfying the above demands. Accordingly, the level of the functions demanded for the toner has become even higher, and a better image forming apparatus in actuality is not realized if an improvement of the toner performance cannot be achieved.

For example, a contact developing device adopting a one-component contact developing system is widely prevalent recently, especially for a color device, in a developing step of the electrostatic latent image on the photosensitive member. In the contact developing device for carrying out the development of the latent image, a toner layer on a toner bearing member is brought into contact with a surface of the photosensitive member, and the surface of the photosensitive member and a surface of the toner bearing member moving mutually. Further, a transfer device for electrostatically transferring the toner image on the electrostatic latent image bearing member or an intermediate transferring member to the transfer material, in many cases, employs a contact transfer device. In the contact transfer device, a roll transferring member is brought in contact with the electrostatic latent image bearing member or the intermediate transferring member through the transfer material, that is, contact transfer, in view of miniaturization of the image forming apparatus, prevention of ozone generation, or the like.

Controlling a particle shape of the toner to a sphere, for such a contact developing device or a contact transfer device, is effective for improving developability, transferability, and in addition, resistance to mechanical stress received from those devices. However, at the same time, small specific surface area and volume of the spherical toner particles resulted in more than anticipated effects of dispersibility of the colorant inside the toner particles on developability, transferability, and in addition, matching with the image forming apparatus.

Such a phenomenon tends to occur easily with a black toner employing carbon black having a specific surface area larger than those of other colorants and having conductivity. The phenomenon becomes conspicuous particularly with a toner produced through polymerization.

On the other hand, a heat roller-type heat fixing means is widely used as a fixing device for fixing the toner image. The heat roller-type fixing means is provided with a heat roller as a rotary heating member and a pressure roller as a rotary pressing member (hereinafter, both rollers are collectively referred to as "fixing roller"). The toner was desired to express high sharp-melt property during heating thereof along with miniaturization, speeding up, and power saving of the fixing device. Further, such a toner excels not only in low-temperature fixability, but also in color-mixing property during full-color image forming, and thus, color reproduction range of a fixed image to be obtained could be broadened.

However, such a toner expressing the sharp-melt property generally has high affinity with the fixing roller and tends to cause an offset phenomenon easily, which is a phenomenon of the toner to transfer to a surface of the fixing roller during fixing. The offset phenomenon occurs conspicuously, in particular, during color image forming when a plurality of toner layers form on the transfer material.

Correspondingly, the surface of the fixing roller is coated with a thin film composed of an offset preventing liquid for preventing the offset phenomenon. However, such a method results in adverse effects such as causing upsizing or complication of the fixing device, impairing solid attachment of the fixed image caused by adhesion of the offset preventing liquid, and impairing transparency of a transparency film used for an overhead projector for presentations.

Incidentally, the transfer material used for the image forming apparatus has also been diversified. A type of paper used as the transfer material, for example, not only differs in weight capacity but also varies in materials or content of raw materials or fillers under the present situation. A recycled paper employing a recycled pulp obtained by deinking the paper once used has been widely used recently from a view of environmental protection or the like. An amount of the recycled pulp mixed in the recycled paper and the amount of the recycled paper is presumed to increase more hereafter. Quality of the transfer material varies that the transfer material such as the recycled paper contains components which easily detach therefrom or which easily attach to members of the fixing device. An effect of those transfer materials on the fixing device is large, thereby making miniaturization or life extension of the fixing device difficult. For example, a cleaning member for removing the residual toner or the like from fixing or a separating member for preventing wrapping of the transfer material are arranged on a surface of the heat roller. The arrangements have been confirmed to result in: formation of damages or scratches on the surface of the fixing roller by medium-density fibers in paper powder detached from the recycled paper obtained from, particularly, raw materials of medium-density waste paper such as newspapers and magazines; and remarkable reduction of functions of the cleaning member or the separating member. Such phenomena tend to become more critical issues when using a fixing device with a small amount of the offset preventing liquid applied to the fixing roller or using a fixing device without the application of the offset preventing liquid.

Under such circumstances, technological developments regarding the low-temperature fixability and anti-offset property of the toner have become indispensable. In actuality, multiple strategies with an improved binder resin or wax component have been proposed, but behaviors of the colorant in the toner particles during fixing are hardly studied.

The inventors of the present invention have found out through studies that the colorant such as the pigments in the toner particles not only deprives the binder resin of the sharp-melt property, but the colorant itself also behaves as a fixing inhibitor. In addition, the inventors of the present invention have found out that the colorant possesses a function of disturbing migration of the wax component from the toner particles, thereby degrading the low-temperature fixability and the anti-offset property.

Those phenomena tend to occur more easily with the black toner employing carbon black which has a fine primary particle size and is hardly dispersed uniformly in the toner particles than with other colorant. Those phenomena become conspicuous particularly with a toner produced by polymerization.

The black toner is not only important in office use for reproducing text images, but is also frequently used in graphic images. Here, even finer developability and better low-temperature fixability are demanded for the former case because the amount of the toner used is small for the toner image formed on the transfer material. On the other hand, excellent transferability and anti-offset property are demanded for the latter case because the amount of the toner used, including other chromatic colors, is large for the toner image formed on the transfer material. Therefore, the black toner must achieve satisfactory fixability in a wide temperature range in addition to further improvement in developability or transferability.

Various techniques have been disclosed so far for improving the dispersibility of the carbon black in the toner particles.

For example, JP 2000-352844 A discloses that combining carbon black of a fine particle size and a specific azo metal compound in the presence of a wax component reduces cohesion of the carbon black in the toner particles and liberation from the toner particles. The document also discloses that adaptation of the combination is possible also for a toner produced through polymerization.

However, the specific azo metal compound used in the toner generally expresses pigment-like property, and thus, the azo metal compound had to be treated by adding high shearing force under specific conditions to function as a dispersant. Therefore, dispersibility of the azo metal compound had a limit, and further improvement had been desired regarding fixability, in particular.

Further, JP 05-070511 A discloses a method of producing a toner of a fine particle size through suspension polymerization process using Ti phthalocyanine or soluble Cu phthalocyanine as a dispersant aid for the carbon black.

The toner have improved coloring power and chargeability to some level, but nothing was considered on environmental stability or matching with an image forming apparatus. Further, as the inventors of the present invention have studied, in the case any of the above phthalocyanine compound is used, the dispersibility of carbon black or a polymerizable monomer composition are controlled by functional groups directly bonded to phthalocyanine rings, thereby not providing sufficient dispersion stability. The inventors of the present invention have found out that production of a toner through polymerization process provokes phenomena such as re-aggregation of the carbon black or migration thereof to a surface of the toner particles along with proceeding of a polymerization reaction of the polymerizable monomer.

On the other hand, JP 11-327208 A discloses a technique of applying a charge control resin comprising an acrylamide monomer having a sulfonic group as a component to a toner produced through polymerization.

Those toners are capable of forming a full-color image expressing satisfactory coloring power. However, the inventors of the present invention have found out through studies that further improvement of a dispersion state of a colorant in toner particles have been required. In other words, dispersion stability is not sufficient because improvement in the dispersibility of the colorant is attempted only with the charge control resin. Therefore, the colorant satisfactorily dispersed in a preparation stage of a polymerizable monomer composition provokes phenomena such as re-aggregation of the colorant or migration of the colorant to the surface of the toner particles. Such a toner has not yet further improved in low-temperature fixability or matching with an image forming apparatus.

Further, not much was considered on effects of the colorant on a contact developing device, a contact transfer device, or the like with respect to any of the toners exemplified above. Further, nothing was considered on: residue of aromatic amine derived from raw materials of a colorant; case of using a recycled paper as a transfer material having more than 70% of recycled pulp in mixing ratio; case of forming a color image requiring fixing of a plurality of toner layers formed on a transfer material at once; and performance in a case of using a fixing device with a small amount of an offset preventing liquid applied to a fixing roller or using a fixing device without the application of the offset preventing liquid.

Namely, a system design of the image forming apparatus using the contact developing means, the contact transfer means, or the heat pressure fixing means as described above is not yet sufficient in overall strategies embracing the colorant used for the toner.

SUMMARY OF THE INVENTION

The present invention has been made in view of the above, and an object of the present invention is therefore to provide a dry toner resolving problems of conventional art, a method for producing the dry toner, and a method for forming an image using the dry toner. That is, an object of the present invention is to provide a toner having a significantly improved dispersibility of a colorant in toner particles.

The present invention relates to a dry toner comprising: (i) a binder resin; (ii) a colorant; (iii) at least one of metallophthalocyanine and a metallophthalocyanine derivative having a central metal selected from the group consisting of Cr, Fe, Co, Ni, Zn, Mn, Mg, and Al; and (iv) at least one of (a) a polymer containing 0.5 to 20% by mass of a base unit derived from a polymerizable monomer represented by the following structural formula (1), (b) a polymer containing 0.5 to 20% by mass of a base unit derived from a polymerizable monomer represented by the following structural formula (2), and (c) a polymer containing 0.5 to 20% by mass each of a base unit derived from a polymerizable monomer represented by the following structural formula (3) and a vinyl monomer having a carboxyl group:

(1)

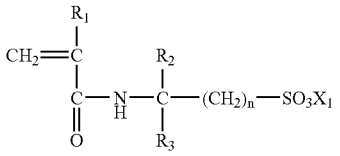

(wherein, $R_1$, represents a hydrogen atom or a methyl group; $R_2$ and $R_3$ each represent independently a hydrogen atom, an aryl group, a $C_1$ to $C_{10}$ alkyl group, a $C_1$ to $C_{10}$ alkenyl group, or a $C_1$ to $C_{10}$ alkoxy group; $X_1$ represents a hydrogen atom, an alkali metal atom, an alkaline earth metal atom, or a quaternary ammonium salt; and n represents an integer of 1 to 10)

(2)

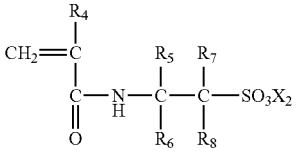

(wherein, $R_4$ represents a hydrogen atom or a methyl group; $R_5$ to $R_8$ each represent independently a hydrogen atom, an aryl group, an aromatic group, a $C_1$ to $C_{10}$ alkyl group, a $C_1$ to $C_{10}$ alkenyl group, or a $C_1$ to $C_{10}$ alkoxy group but at least one of $R_5$ to $R_8$ represents an unsubstituted or substituted aromatic group; and $X_2$ represents a hydrogen atom, an alkali metal atom, an alkaline earth metal atom, or a quaternary ammonium salt)

(3)

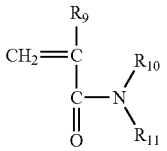

(wherein, $R_9$ represents a hydrogen atom or a methyl group; $R_{10}$ and $R_{11}$ each represent independently a hydrogen atom, an aryl group, a $C_1$ to $C_{20}$ alkyl group, a $C_1$ to $C_{20}$ alkenyl group, or a $C_1$ to $C_{20}$ alkoxy group and $R_{10}$ and $R_{11}$ may be coupled together to form a nonaromatic organic group having different atoms except a carbon atom and a cyclic structure of $C_4$ to $C_{20}$).

Further, the present invention relates to a method for producing a dry toner comprising: a phthalocyanine treatment step of mixing at least (iii) at least one of metallophthalocyanine and a metallophthalocyanine derivative having a central metal selected from the group consisting of Cr, Fe, Co, Ni, Zn, Mn, Mg, and Al and (iv) at least one of (a) a polymer containing 0.5 to 20% by mass of a base unit derived from a polymerizable monomer represented by the following structural formula (1), (b) a polymer containing 0.5 to 20% by mass of a base unit derived from a polymerizable monomer represented by the following structural formula (2), and (c) a polymer containing 0.5 to 20% by mass each of a base unit derived from a polymerizable monomer represented by the following structural formula (3) and a vinyl monomer having a carboxyl group, in such a manner that an absorbance of the highest absorption peak in visible absorption spectra exhibited by the metallophthalocyanine and/or the metallophthalocyanine derivative after the mixing is reaches 5 or more times as high as that before mixing.

Further, the present invention relates to a method for forming an image comprising the steps of: charging an electrostatic latent image bearing member by externally applying a voltage to a charging member; forming an electrostatic latent image on the charged electrostatic latent image bearing member; developing the electrostatic latent image with a toner to form a toner image on the electrostatic latent image bearing member; transferring the toner image on the electrostatic latent image bearing member to a transfer material through or without an intermediate transferring member; and fixing the toner image on the transfer material through a heat pressure means to form a fixed image on the transfer material, wherein: (I) the heat pressure means is provided with a rotary heating member having a heating medium and a rotary pressing member forming a nip portion in press contact with the rotary heating member, (II) the heat pressure means consumes 0 to 0.025 mg/cm$^2$, based on a unit area of the transfer material, of an offset preventing liquid applied to a contact surface of the rotary heating member with the toner image on the transfer material, and (III) the heat pressure means fixes the toner image on the transfer material under heat and pressure through the rotary heating member and the rotary pressing member while nipping and conveying the transfer material within the nip portion; and the toner is a dry toner comprising: (i) a binder resin; (ii) a colorant; (iii) at least one of metallophthalocyanine and a metallophthalocyanine derivative having a central metal selected from the group consisting of Cr, Fe, Co, Ni, Zn, Mn, Mg, and Al and (iv) at least one of (a) a polymer containing 0.5 to 20% by mass of a base unit derived from a polymerizable monomer represented by the following structural formula (1), (b) a polymer containing 0.5 to 20% by mass of a base unit derived from a polymerizable monomer represented by the following structural formula (2), and (c) a polymer containing 0.5 to 20% by mass each of a base unit derived from a polymerizable monomer represented by the following structural formula (3) and a vinyl monomer having a carboxyl group.

BRIEF DESCRIPTION OF THE DRAWINGS

Other objects and advantages of the present invention will become apparent during the following discussion conjunction with the accompanying drawings, in which.

DETAILED DESCRIPTION OF THE INVENTION

Figure 1:
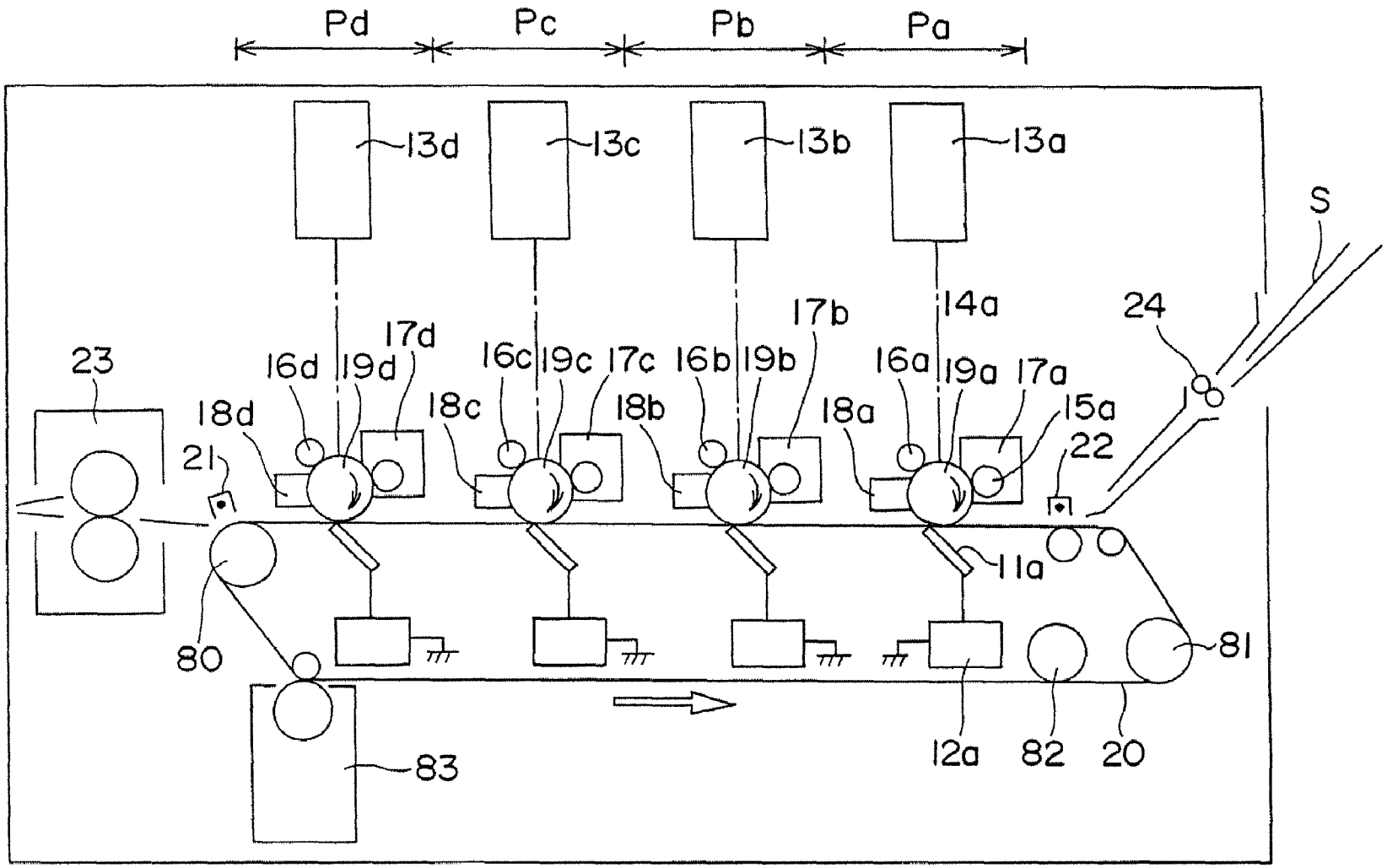
FIG. 1 is a schematic diagram showing an example of a structure of a full-color image forming apparatus capable of suitably employing a toner of the present invention.

The inventors of the present invention have made extensive studies to find that incorporation of a specific metallophthalocyanine and a polymer containing a specific base unit derived from a specific polymerizable monomer having an amide group in dry toner significantly improves the dispersibility of a colorant in toner particles, thereby accomplishing the present invention.

[Dry Toner]

First, constitutional characteristics of the dry toner of the present invention, raw materials for the dry toner to be used, and the like are described.

The dry toner (hereinafter, referred to as "toner") of the present invention includes at least: (i) a binder resin; (ii) a colorant; (iii) at least one of metallophthalocyanine and a metallophthalocyanine derivative having a central metal selected from the group consisting of Cr, Fe, Co, Ni, Zn, Mn, Mg, and Al; and (iv) at least one of (a) a polymer containing 0.5 to 20% by mass of a base unit derived from a polymerizable monomer represented by the following structural formula (1), (b) a polymer containing 0.5 to 20% by mass of a base unit derived from a polymerizable monomer represented by the following structural formula (2), and (c) a polymer containing 0.5 to 20% by mass each of a base unit derived from a polymerizable monomer represented by the following structural formula (3) and a vinyl monomer having a carboxyl group:

(1)

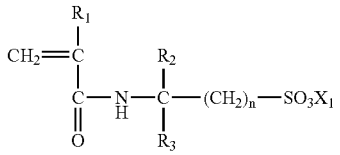

(wherein, $R_1$ represents a hydrogen atom or a methyl group; $R_2$ and $R_3$ each represent independently a hydrogen atom, an aryl group, a $C_1$ to $C_{10}$ alkyl group, a $C_1$ to $C_{10}$ alkenyl group, or a $C_1$ to $C_{10}$ alkoxy group; $X_1$ represents a hydrogen atom, an alkali metal atom, an alkaline earth metal atom, or a quaternary ammonium salt; and n represents an integer of 1 to 10)

(2)

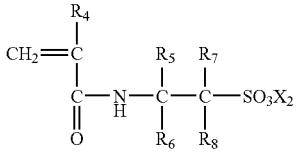

(wherein, $R_4$ represents a hydrogen atom or a methyl group; $R_5$ to $R_8$ each represent independently a hydrogen atom, an aryl group, an aromatic group, a $C_1$ to $C_{10}$ alkyl group, a $C_1$ to $C_{10}$ alkenyl group, or a $C_1$ to $C_{10}$ alkoxy group but at least one of $R_5$ to $R_8$ represents an unsubstituted or substituted aromatic group; and $X_2$ represents a hydrogen atom, an alkali metal atom, an alkaline earth metal atom, or a quaternary ammonium salt)

(3)

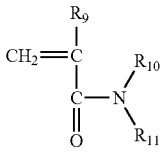

(wherein, $R_9$ represents a hydrogen atom or a methyl group; $R_{10}$ and $R_{11}$ each represent independently a hydrogen atom, an aryl group, a $C_1$ to $C_{20}$ alkyl group, a $C_1$ to $C_{20}$ alkenyl group, or a $C_1$ to $C_{20}$ alkoxy group and $R_{10}$ and $R_{11}$ may be coupled together to form a nonaromatic organic group having different atoms except a carbon atom and a cyclic structure of $C_4$ to $C_{20}$).

The above constitution of the toner can significantly improve the dispersibility of the colorant in toner particles and provide desired properties to the toner.

In the present invention the term "a base unit derived from a polymerizable monomer" means the base unit that is formed from the corresponding polymerizable monomer through a polymerization reaction.

The toner of the present invention is constituted of toner particles as fine colored particles each containing: a binder resin; a colorant; metallophthalocyanine and/or a metallophthalocyanine derivative; and a polymer containing a base unit derived from a specific polymerizable monomer having an amide group. Various additives may be mixed with and added to the toner particles as required.

In the present invention, as described above, coexistence of a specific metallophthalocyanine and/or a metallophthalocyanine derivative and a polymer containing a base unit derived from a specific polymerizable monomer having an amide group in the toner significantly improves the dispersibility of a colorant in toner particles. The inventors of the present invention consider the reason for the significant improvement as follows.

Metallophthalocyanine and/or a metallophthalocyanine derivative (hereinafter, referred to as "metallophthalocyanines") each having a central metal selected from the group consisting of Cr, Fe, Co, Ni, Zn, Mn, Mg, and Al can adopt a geometry of 5- or 6-coordination which can coordinate a ligand to a phthalocyanine ring as a macrocyclic compound in an axial direction.

Meanwhile, a polymer containing a base unit derived from a specific polymerizable monomer having an amide group to be used in the present invention, that is, at least one of (a) a polymer containing 0.5 to 20% by mass of a base unit derived from a polymerizable monomer represented by the following structural formula (1), (b) a polymer containing 0.5 to 20% by mass of a base unit derived from a polymerizable monomer represented by the following structural formula (2), and (c) a polymer containing 0.5 to 20% by mass each of a base unit derived from a polymerizable monomer represented by the following structural formula (3) and a vinyl monomer having a carboxyl group (hereinafter, referred to as "polymer ligand"), acts as a polymer ligand on the phthalocyanine ring because the polymer has an unshared electron pair. Therefore, coexistence of the metallophthalocyanines and the polymer can result in the formation of a polymer complex.

In a polymer complex obtained through the coordination of a polymer ligand to metallophthalocyanines to be used in the present invention, a phthalocyanine ring site exhibits good affinity for a colorant and a polymer site exhibits affinity for a binder resin and other toner components and which prevents re-aggregation by virtue of steric hindrance. The inventors consider that the above fact results in a good dispersibility of the colorant in the toner.

Metallophthalocyanines to be used in the present invention each employ a divalent metal, a trivalent or tetravalent substituted metal, or an oxymetal as a central metal because each of the metallophthalocyanines must adopt a geometry of 5- or 6-coordination. Specifically, the central metal is any one selected from the group consisting of Cr, Fe, Co, Ni, Zn, Mn, Mg, and Al. The central metal of each of the metallophthalocyanines is preferably any one selected from the group consisting of Cr, Fe, Co, Zn, and Mn in consideration of the ease with which an axial ligand is taken in. Zn phthalocyanine (zinc phthalocyanine) having Zn as its central metal represented by the following structural formula (4) which can adopt a geometry of 5-coordination is preferably selected in consideration of adsorbability to a colorant.

(4)

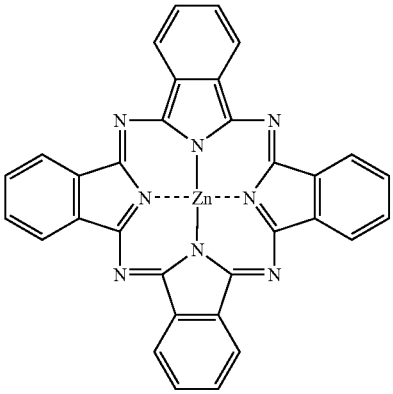

Known metallophthalocyanines can be used in the present invention. In other words, the metallophthalocyanines are not particularly limited as long as the metallophthalocyanines each have a phthalocyanine skeleton. For instance, metallophthalocyanines in each of which substituents such as a carboxylic acid group and a sulfonic group are introduced into four isoindole parts or metallophthalocyanines in each of which substituents such as an aromatic group, an aliphatic group, an ether group, and an alcohol radical are introduced are used. However, metallophthalocyanines which affect the adsorbability of a phthalocyanine ring to a colorant and the ease with which an axial ligand is taken in are not preferable.

In the present invention, metallophthalocyanines form a polymer complex with a polymer containing a base unit derived from a specific polymerizable monomer having an amide group described later as a polymer ligand, and acts as a dispersant on a colorant. Therefore, an extremely small addition amount of the metallophthalocyanines achieves an object of the present invention. The addition amount falls within the range in which the coloring power of the metallophthalocyanines is negligible. Specifically, the addition amount is 0.01 to 0.5 parts by mass, preferably 0.03 to 0.3 parts by mass with respect to 100 parts by mass of a binder resin, although the addition amount varies depending on the type and addition amount of the colorant to be simultaneously used.

A polymer containing a base unit derived from a specific polymerizable monomer having an amide group to be used as the polymer ligand for the metallophthalocyanines to be used in the present invention is a polymer containing at least 0.5 to 20% by mass of (a) a polymer containing 0.5 to 20% by mass of a base unit derived from a polymerizable monomer represented by the following structural formula (1), (b) a polymer containing 0.5 to 20% by mass of a base unit derived from a polymerizable monomer represented by the following structural formula (2), or (c) a polymer containing 0.5 to 20% by mass each of a base unit derived from a polymerizable monomer represented by the following structural formula (3) and a vinyl monomer having a carboxyl group.

Such a polymer ligand can act as the polymer ligand on the above metallophthalocyanines because the polymer has an unshared electron pair in a molecular structure of a polymerizable monomer represented by any one of the above structural formulae (1) to (3). Thus, the polymer forms a polymer complex with the metallophthalocyanines.

In addition, the polymer as the polymer ligand to be used in the present invention containing a polymerizable monomer represented by any one of the above structural formulae (1) to (3) provides negative charge controllability. Therefore, the polymer not only provides a preferably improved dispersibility of a colorant in toner particles but also enables negatively chargeable toner to express preferable properties with regard to both the dispersibility of the colorant and chargeability.

In the above structural formula (1), $R_1$ represents a hydrogen atom or a methyl group; $R_2$ and $R_3$ each represent independently a hydrogen atom, an aryl group, a $C_1$ to $C_{10}$ alkyl group, a $C_1$ to $C_{10}$ alkenyl group, or a $C_1$ to $C_{10}$ alkoxy group; $X_1$ represents a hydrogen atom, an alkali metal atom, an alkaline earth metal atom, or a quaternary ammonium salt; and n represents an integer of 1 to 10.

Specific examples of the polymerizable monomers represented by the above structural formula (1) include: 2-(meth)acrylamide-2-methylpropanesulfonic acid, 2-(meth)acrylamide-n-butanesulfonic acid, 2-acrylamide-n-hexanesulfonic acid, 2-(meth)acrylamide-n-octanesulfonic acid, 2-(meth)acrylamide-n-dodecanesulfonic acid, 2-(meth)acrylamide-n-tetradecanesulfonic acid, and 2-(meth)acrylamide-2,2,4-trimethylpentanesulfonic acid; and alkali metal salts, alkaline earth metal salts, and quaternary ammonium salts thereof. Of those, 2-acrylamide-2-methylpropanesulfonic acid (corresponding to a compound having the above structural formula (1) wherein, $R_1$ represents a hydrogen atom, $R_2$ and $R_3$ each represents a methyl group, $X_1$ represents a hydrogen atom, and n represents 1), or the like is preferably used.

Further, in the above structural formula (2), $R_4$ represents a hydrogen atom or a methyl group; $R_5$ to $R_8$ each represent independently a hydrogen atom, an aryl group, an aromatic group, a $C_1$ to $C_{10}$ alkyl group, a $C_1$ to $C_{10}$ alkenyl group, or a $C_1$ to $C_{10}$ alkoxy group but at least one of $R_5$ to $R_8$ represents an unsubstituted or substituted aromatic group; and $X_2$ represents a hydrogen atom, an alkali metal atom, an alkaline earth metal atom, or a quaternary ammonium salt.

Specific examples of the polymerizable monomers represented by the above structural formula (2) include: 2-acrylamide-1-phenylethanesulfonic acid, 2-acrylamide-2-phenylethanesulfonic acid, 2-acrylamide-1-(4-methylphenyl) ethanesulfonic acid, 2-acrylamide-2-(4-methylphenyl) ethanesulfonic acid, 2-acylamide-1-methyl-1-phenylethanesulfonic acid, 2-acrylamide-2-methyl-2-phenylethanesulfonic acid, 2-acrylamide-1-(4-tert-butylphenyl)ethanesulfonic acid, 2-acrylamide-2-(4-tert-butylphenyl)ethanesulfonic acid, 2-acrylamide-1-(4-chlorophenyl)ethanesulfonic acid, and 2-acrylamide-2-(4-chlorophenyl)ethanesulfonic acid; and alkali metal salts, alkaline earth metal salts, and quaternary ammonium salts thereof. Of those, 2-acrylamide-2-(4-methylphenyl)ethanesulfonic acid, (corresponding to a compound having the above structural formula (2) where $R_4$ represents a hydrogen atom, $R_5$ represents a hydrogen atom, $R_6$ represents a 4-methylphenyl group, $R_7$ represents a hydrogen atom, $R_8$ represents a hydrogen atom, and $X_2$ represents a hydrogen atom) or the like is preferably used.

Further, in the above structural formula (3), $R_9$ represents a hydrogen atom or a methyl group; $R_{10}$ and $R_{11}$ each represent independently a hydrogen atom, an aryl group, a $C_1$ to $C_{20}$ alkyl group, a $C_1$ to $C_{20}$ alkenyl group, or a $C_1$ to $C_{20}$ alkoxy group and $R_{10}$ and $R_{11}$ may be coupled together to form a nonaromatic organic group having different atoms except a carbon atom and a cyclic structure of $C_4$ to $C_{20}$.

Specific examples of the polymerizable monomers represented by the above structural formula (3) include: (meth) acrylamide; N-butoxymethyl(meth)acrylamide; N-substituted (meth)acrylamides such as N,N-dimethyl(meth) acrylamide, N-methyl(meth)acrylamide, N-isopropyl(meth) acrylamide, and N-methylol(meth)acrylamide; and (meth) acrylamides having a cyclic structure such as N-(meth) acryloylmorpholine, N-(meth)acryloylpyrrolidone, N-(meth)acryloylpiperidine, N-(meth)acryloylpyrrolidine, and N-(meth)acryloyl-4-piperidone. Of those, N-butoxymethylacrylamide (corresponding to a compound having the above structural formula (3) where $R_9$ represents a hydrogen atom, $R_{10}$ represents a butoxy group, and $R_{11}$ represents a methyl group) or the like is preferably used.

Preferable examples of the vinyl monomers having a carboxyl group combined with the polymerizable monomer represented by the above structural formula (3) include maleic acid, half esters of maleic acid, fumaric acid, half esters of fumaric acid, itaconic acid, half esters of itaconic acid, crotonic acid, cinnamic acid, and vinyl monomer including a carboxyl group represented by the following structural formula (5) or (6), as those compounds easily adjust the dispersion state of a colorant in a binder resin.

(5)

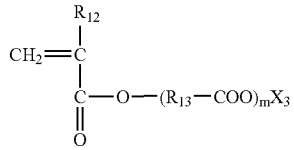

[wherein, $R_{12}$ represents a hydrogen atom or a methyl group; $R_{13}$ represents a $C_2$ to $C_6$ alkylene group; $X_3$ represents a hydrogen atom, an alkali metal atom, an alkaline earth metal atom, or quaternary ammonium salt; and m represents an integer of 0 to 10.]

(6)

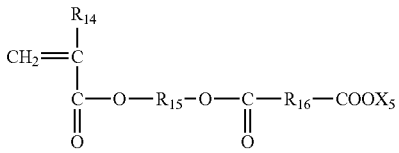

[wherein, $R_{14}$ represents a hydrogen atom or a methyl group; $R_{15}$ represents a $C_2$ to $C_4$ alkylene group; $R_{16}$ represents an ethylene group, a vinylene group, or a 1,2-cyclohexylene group; and $X_5$ represents a hydrogen atom, an alkali metal atom, an alkaline earth metal atom, or quaternary ammonium salt.]

Examples of the polymerizable monomers represented by the above structural formula (5) include (meth)acrylic acid, (meth)acrylic acid dimer, and ω-carboxy-polycaprolactone mono(meth)acrylate. Further, examples of the polymerizable monomers represented by the above structural formula (6) include succinic monohydroxyethyl(meth)acrylate, maleic monohydroxyethyl(meth)acrylate, fumaric monohydroxyethyl(meth)acrylate, phthalic monohydroxyethyl (meth)acrylate, and 1,2-dicarboxycyclohexanemonohydroxyethyl(meth)acrylate. Of those, (meth)acrylic acid, and succinic monohydroxyethyl(meth)acrylate are more preferable.

In the case where a polymer containing at least a base unit derived from a polymerizable monomer represented by the structural formula (1) (hereinafter, referred to as "R-1 type polymer") or a polymer containing at least a base unit derived from a polymerizable monomer represented by the structural formula (2) (hereinafter, referred to as "R-2 type polymer") is used as a polymer to serve as a polymer ligand in the present invention, each polymerizable monomer represented by the structural formula (1) or (2) is contained in the R-1 type polymer or the R-2 type polymer in such a manner that the polymerizable monomer content in the polymer is 0.5 to 20% by mass (with reference to the total mass of the monomer used for the polymer). The polymerizable monomer content is preferably 0.5 to 15% by mass, more preferably 3 to 15% by mass. In the present invention, containing 0.5 to 20% by mass of a base unit derived from the polymerizable monomer represented by the structural formula (1) or (2) in the R-1 type polymer or the R-2 type polymer may containing 0.5 to 20% by mass of only the polymerizable monomer represented by the structural formula (1) in the R-1 type polymer. Alternatively, it may containing 0.5 to 20% by mass of only the polymerizable monomer represented by the structural formula (2) in the R-2 type polymer. Alternatively, it may containing both the polymerizable monomer represented by the structural formula (1) and the polymerizable monomer represented by the structural formula (2) in the R-1 type polymer or the R-2 type polymer such that the total polymerizable monomer content is 0.5 to 20% by mass.

In addition, in the case where a polymer containing a base unit derived from a polymerizable monomer represented by the structural formula (3) and a base unit derived from a vinyl monomer having a carboxyl group (hereinafter, referred to as "R-3 type polymer") is used as a polymer to serve as a polymer ligand, the polymerizable monomer represented by the structural formula (3) is contained in the R-3 type polymer in such a manner that the polymerizable monomer content in the polymer is 0.5 to 20% by mass (with reference to the total mass of the monomer used for the polymer). The polymerizable monomer content is preferably 0.5 to 15% by mass, more preferably 3 to 15% by mass.

If the content of the base unit derived from the polymerizable monomer represented by the structural formula (1) or (2) in the R-1 type polymer or in the R-2 type polymer or the content of the base unit derived from the polymerizable monomer represented by the structural formula (3) in the R-3 type polymer is less than 0.5% by mass, the ability as a polymer ligand cannot be exhibited and thus the dispersion effect of the colorant cannot be obtained. If the content exceeds 20% by mass, the chargeability of the toner is adversely affected, in particular, a problem is posed for environmental stability. Furthermore, in producing toner particles through a polymerization process, it becomes difficult to control a shape of a toner particle.

The content of a base unit derived from a vinyl monomer having a carboxyl group in a polymer (R-3 type polymer) containing a base unit derived from a polymerizable monomer represented by the structural formula (3) and a base unit derived from the vinyl monomer having a carboxyl group is 0.5 to 20% by mass. In addition, the R-3 type polymer is preferably obtained through copolymerization of the polymerizable monomer represented by the structural formula (3) and the carboxyl group-containing vinyl monomer at a mass ratio of 1:5 to 3:1. A content of the polymerizable monomer represented by the structural formula (3) in the R-3 type polymer lower than the above ratio is not preferable because the ability of the polymer as a polymer ligand is liable to decrease. A content of the vinyl monomer having a carboxyl group in the R-3 type polymer lower than the above ratio is not preferable either because the chargeability is liable to become unstable.

Such a polymer to serve as a polymer ligand as described above may be a combination of two or more types of polymerizable monomers represented by the above structural formulae (1) to (3). That is, a polymer to serve as a polymer ligand to be used in the present invention may be an R-1 or R-2 type polymer further containing a base unit derived from a polymerizable monomer represented by the above structural formula (3) and a base unit derived from a vinyl monomer having a carboxyl group. Alternatively, the polymer may be an R-3 type polymer further containing at least one base unit derived from a polymerizable monomer represented by the above structural formula (1) and/or the above structural formula (2). Alternatively, the polymer may be a mixture of the R-1 type polymer, the R-2 type polymer, and the R-3 type polymer as described above.

The polymer to serve as a polymer ligand to be used in the present invention is preferably an oligomer or polymer having a number average molecular weight (Mn) in the range of 500 to 50,000. Furthermore, the polymer is preferably soluble in a styrene monomer from the viewpoints of dispersibility in a binder resin, chargeability of the toner, and matching with an image forming apparatus.

A polymerizable monomer to be used for the polymer ligand together with the polymerizable monomers represented by the above structural formulae (1) to (3) is not particularly limited as long as the polymerizable monomer is copolymerizable with at least one polymerizable monomer represented by the structural formula (1) and/or the structural formula (2) in the R-1 type polymer or the R-2 type polymer and is copolymerizable with the polymerizable monomer represented by the structural formula (3) and the vinyl monomer having a carboxyl group in the R-3 type polymer. However, the polymerizable monomer is preferably a polymerizable vinyl monomer in order to enhance affinity for a binder resin. The same polymerizable monomer as that constitutes a binder resin described below or a binder resin to be used in a method of directly obtaining toner particles through a polymerization process is particularly preferably used. In addition, at this time, a crosslinking agent may be added in such a small amount that does not inhibit the dispersibility of a colorant.

A known dye, pigment, magnetic material, or the like is used as the colorant to be contained in the toner of the present invention. In particular, even when carbon black having a particle diameter of 50 nm or less, a cyan colorant selected from the group consisting of a Cu phthalocyanine compound and a derivative thereof, an anthraquinone compound, and a basic dye lake compound, and the like, both colorants of which have been conventionally very difficult to uniformly disperse, are preferable because even those colorants can be uniformly dispersed in the toner particles and the effect of the present invention can be further exhibited. The addition amount of the colorant is preferably 1 to 20 parts by mass with respect to 100 parts by mass of the binder resin in the toner.

Specific examples of the binder resin which is contained in the toner of the present invention include a styrene-(meth) acrylic copolymer, a polyester resin, an epoxy resin, and a styrene-butadiene copolymer. In addition, a monomer for forming a binder resin is used in a method of directly obtaining toner particles through a polymerization process. Specific examples of the monomers to be preferably used include: styrene; styrene monomers such as o-(m-, p-) methylstyrene and m-(p-) ethylstyrene; (meth)acrylate monomers such as methyl(meth)acrylate, ethyl(meth)acrylate, propyl(meth)acrylate, butyl(meth)acrylate, octyl(meth) acrylate, dodecyl(meth)acrylate, stearyl(meth)acrylate, behenyl(meth)acrylate, 2-ethylhexyl(meth)acrylate, dimethylaminoethyl(meth)acrylate, and diethylaminoethyl (meth)acrylate; and ene monomers such as butadiene, isoprene, cyclohexene, (meth)acrylonitrile, and acrylic amide. Those monomers are used alone, or, in general, are appropriately mixed before use to show a theoretical glass transition temperature (Tg) described in Polymer Handbook 2nd edition III, p 139-192 (John Wiley & Sons) in the range of 40 to 75° C. A theoretical glass transition temperature (Tg) of less than 40° C. tends to pose a problem for the storage stability or endurance stability of the toner, whereas a theoretical glass transition temperature in excess of 75° C. causes a rise in the fixing temperature of the toner.

Furthermore, in the present invention, a crosslinking agent is preferably used when synthesizing the binder resin in order to enhance the mechanical strength of the toner particles.

Examples of bifunctional crosslinking agents among the crosslinking agents to be used in the dry toner of the present invention include divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, polyethylene glycol #200, #400, or #600 diacrylate, dipropylene glycol diacrylate, polypropylene glycol diacrylate, polyester diacrylates (MANDA, manufactured by Nippon Kayaku Co., Ltd.), and those obtained by changing the "diacrylate" to "dimethacrylate".

Examples of polyfunctional crosslinking agents include pentaerythritol triacrylate, trimethylolethane triacrylate, trimethylolpropane triacrylate, tetramethylolmethane tetraacrylate, oligoester acrylate, and methacrylates thereof; 2,2-bis(4-methacryloxy, polyethoxyphenyl)propane, diallyl phthalate, triallyl cyanurate, triallyl isocyanurate and triallyl trimellitate.

The content of those crosslinking agents is preferably 0.01 to 10 parts by mass, preferably 0.1 to 5 parts by mass with respect to 100 parts by mass of the polymerizable monomers constituting the binder resin.

In the present invention, a resin having a polarity (hereinafter, referred to as "polar resin") such as a polyester resin or a polycarbonate resin can be used in combination with the above binder resin. Addition of a polar resin to toner enables the state of presence of the colorant in the toner to be easily controlled as desired, in particular, the exposure state of a colorant to the toner particle surface often occurring when the dispersibility of the colorant in the toner particles is improved.

For example, in the case where toner is directly produced through a suspension polymerization process described below or the like, when such a polar resin as described above is added upon a polymerization reaction starting from a dispersing step and ending in a polymerizing step, the added polar resin can be controlled, according to a balance between a polarity of a polymerizable monomer composition which compose a toner particle and a polarity of an aqueous dispersion medium, to form a thin layer on the toner particle surface or to be present with a gradient from the surface to the center of the toner particle. At this time, the use of a polar resin that is capable of interacting with the metallophthalocyanines or the polymer ligand according to the present invention can control the state of presence of the colorant in the toner particles as desired while controlling the state of exposure of the colorant on the toner particle surface. In particular, a polar resin having an acid value in the range of 1 to 40 mgKOH/g is preferably used.

In the present invention, the addition amount of the polar resin is preferably 1 to 25 parts by mass, more preferably 2 to 15 parts by mass with respect to 100 parts by mass of the binder resin. An addition amount of the polar resin of less than 1 part by mass results in a non-uniform state of presence of the polar resin in the toner particles. Conversely, an addition amount of the polar resin in excess of 25 parts by mass thickens the thin layer of the polar resin to be formed on the toner particle surface. In each of those two cases, the requisite performance of the toner cannot be expressed in a desired balance.

Furthermore, the polar resin as described above is not limited to one type of polymer. For example, two or more types of reactive polyester resins can be simultaneously used. Alternatively, two or more types of vinyl polymers can be used. In addition, the binder resin can be added as required with various polymers of completely different types such as a non-reactive polyester resin, an epoxy resin, a polycarbonate resin, polyolefin, polyvinyl acetate, polyvinyl chloride, polyalkylvinylether, polyalkylvinylketone, polystyrene, poly(meth)acrylate, a melamine-formaldehyde resin, polyethylene terephthalate, nylon, and polyurethane.

In addition, selecting/compounding the colorant in the toner particles of the dry toner of the present invention as described above and precisely controlling the shape distribution of the toner particles prevent the dry toner from deteriorating the charging property and the transfer property even when a number-average equivalent circle diameter (μm) of the toner particles is as small as 2 to 10 μm. As a result, reproducibility of a contour of an image, in particular, a character image or a line pattern, upon development becomes satisfactory. Furthermore, controlling an average circularity of the toner with respect to a frequency distribution of circularity to be within the range of 0.950 to 0.995, preferably within the range of 0.965 to 0.995, particularly preferably within the range of 0.975 to 0.990 significantly improves the charging property of toner with a small particle size which has been conventionally difficult to control and also greatly enhances the ability of the toner to develop a low-potential latent image. Controlling the average circularity of the toner to be within the above range is highly effective particularly in the digital development of a fine spot latent image or in the full-color image formation in which an intermediate transferring member is used to perform many times of transfer, and renders matching with an image forming apparatus satisfactory.

Furthermore, setting the content of toner particles each having a circularity of less than 0.950 with respect to the frequency distribution of circularity of the toner to 30% by number or less, more preferably to 15 number % or less provides a sufficient level of development efficiency to render the image formation satisfactory.

The number-average equivalent circle diameter of toner particles, the average circularity of toner, and the content (% by number) of toner particles each having a circularity of less than 0.950 can be adjusted to be within the above ranges by producing toner particles through the use of a polymerization process.

The equivalent circle diameter and circularity of the toner of the present invention, and their frequency distributions are used as simple measures of quantitatively expressing shapes of toner particles. In the present invention, measurement is carried out by using a flow-type particle image measuring device "FPIA-1000" (manufactured by To a Medical Electronics Co., Ltd.), and the equivalent circle diameter and the circularity are calculated by using the following equations.

Equivalent circle diameter=(area of a projected particle image/$\pi$)$^{1/2}\times 2$ Circularity ($Ci$)=(circumferential length of a circle having an area identical to that of a projected particle image)/(circumferential length of the projected particle image)

In the equation, the "projected particle area" is defined as an area of a binarized toner particle image, and the "circumferential length of the projected particle image" is defined as the length of an outline drawn by connecting edge points of the toner particle image.

The circularity in the present invention is an indication for the degree of irregularities of the toner. If the toner is of a complete spherical shape, the circularity is equal to 1.000. The more complicated the surface shape, the lower the value for the circularity.

In the present invention, the number-average equivalent circle diameter (μm) meaning an average value with respect to a number-basis frequency distribution of the particle diameter of the is calculated from the following equation when a particle diameter (center value) at a divisional point i of a particle diameter distribution is denoted by di and a frequency is denoted by fi.

Number-average Equivalent Circle Diameter $$(DI) = \sum_{i=1}^{n} (fi \times di) \Big/ \sum_{i=1}^{n} (fi)$$

The average circularity meaning an average value with respect to a frequency distribution circularity is calculated from the following equation when a circularity (center value) at the divisional point i of a particle diameter distribution is denoted by ci.

$$\text{Average circularity} = \sum_{i=1}^{m} ci/m$$

A specific measurement method is as follows. 10 ml of ion-exchanged water from which an impurity solid or the like has been removed in advance is charged into a vessel, and a surfactant, preferably an alkyl benzene sulfonate, is added as a dispersant to the water. After that, 0.02 g of a measurement sample is added to the mixture, and is uniformly dispersed. An ultrasonic dispersing unit "UH-50" (manufactured by SMT Co., Ltd.) equipped with a titanium alloy tip having a diameter of 5 mm as an oscillator is used as a dispersing means, and the dispersion treatment is performed for 5 minutes to prepare a dispersion for measurement. At that time, the dispersion is appropriately cooled so as not to have a temperature of 40° C. or higher.

The flow-type particle image measuring device is used to measure the toner shape. The concentration of the dispersion is readjusted such that the toner particle concentration at the time of the measurement is 3,000 to 10,000 particles/μl, and 1,000 or more toner particles are measured. After the measurement, the equivalent circle diameter, frequency distribution of circularity, and the like of the toner are determined by using the data.

Specific examples of known waxes which may be used in the toner of the present invention include: petroleum waxes such as paraffin wax, microcrystalline wax, and petrolatum, and derivatives thereof; montan waxes and derivatives thereof; hydrocarbon waxes obtained by the Fischer-Tropsch method and derivatives thereof; polyolefin waxes such as polyethylene and derivatives thereof; and natural waxes such as carnauba wax, and candelila wax and derivatives thereof. Examples of the derivatives include oxides, block copolymers with vinyl monomers, and graft denatured products. Examples of the waxes further include: alcohols such as higher aliphatic alcohol; fatty acids such as stearic acid and palmitic acid, or compounds thereof; acid amides, esters, ketones, hardening castor oil, and derivatives thereof; plant wax; and animal wax. Those may be used singly or in combination with two or more different types.

An effect of improving developability or transferability of the toner further increases in the case where polyolefin, a hydrocarbon wax obtained by the Fischer-Tropsch method, a petroleum wax, a higher alcohol, or a higher ester is used among them. An antioxidant may be added to those waxes in such an amount that does not affect the chargeability of the toner. In addition, those waxes are preferably used in an amount of 1 to 30 parts by mass with respect to 100 parts by mass of the binder resin.

The wax to be used in the present invention has a melting point of preferably in the range of 30 to 120° C. It is more preferable to use a wax having a melting point in the range of 50 to 110° C. and a wax having a melting point in the range of 80 to 140° C. in combination. At this time, it is particularly preferable that the wax having a melting point in the range of 50 to 110° C. be a polar wax and the wax having a melting point in the range of 80 to 140° C. be a nonpolar wax because the dispersibility of the colorant is not inhibited and because a satisfactory fixing state can be established.

The use of a wax having the heat characteristic as described above can efficiently express satisfactory fixability of the toner to be obtained and a releasing effect by the wax to thereby ensure a sufficient fixing range. In addition, the use of such a wax can eliminate adverse effects of the wax on the developability, blocking resistance, and image forming apparatus as conventionally known in the art. In particular, a specific surface area of the toner decreases as the toner particle shape becomes spherical. Therefore, it is extremely effective to control the heat characteristic and dispersion state of the wax.

The melting point of the wax to be used in the present invention means a main endothermic peak temperature in a DSC curve measured in conformance with "ASTM D3418-82", the main endothermic peak temperature being measured with, for example, "DSC-7" (manufactured by Perkin Elmer, Inc.). At this time, the melting points of iridium and zinc are used for correcting the temperature of a detection portion of the apparatus, and the heat of melting of iridium is used for correcting a quantity of heat. At the time of the measurement, a measurement sample placed in an aluminum pan and only an aluminum pan (an empty pan) as a reference are set in the apparatus. Then, a temperature of the measurement sample is increased at a rate of temperature increase of 10° C./min in the measurement range of 20 to 180° C. to obtain a DSC curve. The melting point can be determined from a main endothermic peak temperature of the DSC curve. In measuring only the wax, temperature increase-temperature decrease is performed under conditions identical to those at the time of the measurement to remove pre-hysteresis before the onset of the measurement. In measuring the wax incorporated in the toner, no operation for removing pre-hysteresis is performed, and the wax is measured as it is.

A known charge-controlling agent can be used to the dry toner of the present invention. A charge-controlling agent which has a high charging speed and is able to stably maintain a constant charge amount is particularly preferably used. Furthermore, in directly producing toner particles through a polymerization process, a charge-controlling agent which has no polymerization inhibiting property and contains no soluble component in an aqueous dispersion medium is preferable. Specific compounds of negative charge-controlling agents include: metal compounds of carboxylic acids such as salicylic acid, naphthoic acid, and a dicarboxylic acid; polymer compounds each having a sulfonic group or a carboxylic acid group at its side chain; boron compounds; urea compounds; silicon compounds; and calixarenes. Specific compounds of positive charge-controlling agents include: quaternary ammonium salt; polymer compounds each having the quaternary ammonium salt at its side chain; guanidine compounds; and imidazole compounds.

However, it is not necessary to add a charge-controlling agent to toner in the present invention. In the case where a two-component development method is employed, a sufficient frictional charge amount can be obtained by utilizing frictional charging with a carrier, so that the toner particles do not have to contain another charge-controlling agent. In the case where a nonmagnetic one-component blade coating development method is employed, a sufficient frictional charge amount can be obtained by actively utilizing frictional charging with a blade or a sleeve, so that the toner particles do not have to contain another charge-controlling agent.

In the present invention, external addition of an inorganic fine powder to the toner particles is a preferable embodiment for enhancing the developability, transferability, electrification stability, flowability, and durability of the toner. Although a known inorganic fine powder can be used in the present invention, an inorganic fine powder selected from the group consisting of silica, alumina, titania, and multiple oxides thereof is particularly preferable. Still more preferable is silica. For example, both of so-called dry silica referred to as fumed silica produced by vapor-phase oxidation of a silicon halogen compound or an alkoxide and so-called wet silica produced from an alkoxide, water glass, or the like can be used as the silica. However, dry silica having a silanol group on the surface of or inside the silica fine powder in a small amount and a production residue such as $Na_2O$ or $SO_3^{2-}$ in a small amount is preferable. In the dry silica production process, other metal halogen compounds such as aluminum chloride and titanium chloride can be used in combination with silicon halogen compounds to yield composite fine powders of silica and other metal oxides, and the composite fine powders are also included in the present invention.

An inorganic fine powder to be used in the present invention having a specific surface area by nitrogen adsorption measured by means of a BET method of 30 $m^2/g$ or more, in particular in the range of 50 to 400 $m^2/g$, provides a satisfactory result. The addition amount of the inorganic fine powder is 0.3 to 8 parts by mass, preferably 0.5 to 5 parts by mass with respect to 100 parts by mass of the toner.

Furthermore, the combined use of an inorganic fine powder having a specific surface area in the range of 50 to 150 $m^2/g$ and an inorganic fine powder having a specific surface area of 170 $m^2/g$ or more at a mass ratio of 5:95 to 50:50 provides a gap between toner particles and provides flowability to the toner particles. As a result, the charge behavior of the toner becomes satisfactory, and an effect of controlling a frictional charge amount or a charging speed increases. In addition, image failure resulting from the contamination or shaving of an electrostatic latent image bearing member or of an intermediate transferring member due to the colorant can be prevented. Furthermore, appropriate flowability is provided to the toner. As a result, uniform chargeability of the toner is synergistically improved and the above-described excellent effect can be maintained even when many sheets are continuously printed out.

An inorganic fine powder having a specific surface area of less than 30 $m^2/g$ makes it difficult to provide appropriate flowability to the toner. An inorganic fine powder having a specific surface area in excess of 400 $m^2/g$ may reduce the flowability of the toner because the inorganic fine powder is embedded in the toner particle surface at the time of the continuous printout.

An addition amount of the inorganic fine powder of less than 0.3 parts by mass precludes the expression of the effect of addition. An addition amount of the inorganic fine powder in excess of 8 parts by mass not only poses problems for the chargeability and fixability of the toner but also remarkably deteriorates matching with an image forming apparatus owing to the free inorganic fine powder.

The inorganic fine powder to be used in the present invention can be and is preferably treated as required with a treatment such as a silicone varnish, each of various denatured silicone varnishes, a silicone oil, each of various denatured silicone oils, a silane coupling agent, a silane coupling agent having a functional group, an organic silicon compound, or an organic titanium compound, or with various treatments used in combination for hydrophobization, control of the chargeability, and the like.

The specific surface area of the inorganic fine powder is measured by adsorbing nitrogen gas to the sample surface by using a specific surface area measuring device "Autosorb 1" (manufactured by Yuasa Ionics, Inc.) and by calculating the specific surface area by using the BET multipoint method.

In order for the toner to maintain a large charge amount and to achieve a low toner consumption and a high transfer efficiency, the inorganic fine powder is still more preferably treated with at least a silicone oil.

The toner particles of the dry toner of the present invention can be further added with other additives before use in such a small amount that has substantially no detrimental effect. Examples of the additives include: lubricant powders such as a fluororesin powder, a zinc stearate powder, and a polyvinylidene fluoride powder; abrasives such as a cerium oxide powder, a silicon carbide powder, and a strontium titanate powder; flowability imparting agents such as a titanium oxide powder and an aluminum oxide powder; anti-caking agents; conductivity imparting agents such as a carbon black powder, a zinc oxide powder, and a tin oxide powder; and developability improvers such as organic and inorganic fine particles having an opposite polarity.

The toner of the present invention can be used as a one-component developer without using a carrier. In addition, the toner of the present invention can be mixed with a carrier to be used as a two-component developer.

When the toner of the present invention is used as a two-component developer, for example, a magnetic carrier to be mixed with the toner is constituted by an element selected from iron, copper, zinc, nickel, cobalt, manganese, chromium, and the like alone or in a composite ferrite state. The shape of the magnetic carrier to be used at this time is spherical, flat, indeterminate shape, or the like. Furthermore, the magnetic carrier with the fine structure on its surface (for instance, surface irregularities) appropriately controlled can be used. A resin-coated carrier with its surface coated with a resin can also be suitably used. The carrier to be used has an average particle diameter of preferably 10 to 100 μm, more preferably 20 to 50 μm. In preparing a two-component developer by mixing those carrier and toner, the toner concentration in the developer is preferably 2 to 15% by mass.

Next, a description is given of a production method for the toner of the present invention.

Each of the following examples is available as a method of producing the dry toner of the present invention. One example is a pulverization process including: melting and kneading a binder resin, a colorant, a wax, and the like in a pressure kneader or the like; cooling the resultant kneaded product; finely pulverizing the cooled kneaded product into products having desired particle diameters; and classifying the finely pulverized products to obtain toner particles while adjusting a particle diameter distribution. Another example is a polymerization process for directly producing toner particles by means of an emulsion polymerization process typified by the suspension polymerization process or a soap-free polymerization process. Still another example is a method in which a melt kneaded product is atomized to the air by using a disk or a multi-fluid nozzle to produce toner particles. However, by using the production method described below, the toner of the present invention with high functionality can be produced with great productivity.

That is, the toner of the present invention is preferably produced by a production method comprising a phthalocyanine treatment step in which metallophthalocyanine and/or a metallophthalocyanine derivative each having a central metal selected from the group consisting of Cr, Fe, Co, Ni, Zn, Mn, Mg, and Al is mixed with (a) a polymer containing 0.5 to 20% by mass of a base unit derived from a polymerizable monomer represented by the following structural formula (1), (b) a polymer containing 0.5 to 20% by mass of a base unit derived from a polymerizable monomer represented by the following structural formula (2), or (c) a polymer containing 0.5 to 20% by mass each of a base unit derived from a polymerizable monomer represented by the following structural formula (3) and a vinyl monomer having a carboxyl group, in such a manner that the absorbance of the highest absorption peak in visible absorption spectra exhibited by the metallophthalocyanine and/or the metallophthalocyanine derivative after the mixing is 5 or more times as high as that before the mixing.

As described above, when metallophthalocyanine and/or a metallophthalocyanine derivative (metallophthalocyanines) each having a central metal selected from the group consisting of Cr, Fe, Co, Ni, Zn, Mn, Mg, and Al is allowed to coexist with (a) a polymer containing 0.5 to 20% by mass of a base unit derived from a polymerizable monomer represented by the following structural formula (1), (b) a polymer containing 0.5 to 20% by mass of a base unit derived from a polymerizable monomer represented by the following structural formula (2), or (c) a polymer containing 0.5 to 20% by mass each of a base unit derived from a polymerizable monomer represented by the following structural formula (3) and a vinyl monomer having a carboxyl group (each polymer is referred to as a polymer ligand), a polymer complex is formed, and the dispersibility and the like of a colorant in toner particles are improved.

The inventors of the present invention have made extensive studies to find the following. That is, when both (metallophthalocyanines and a polymer ligand) are mixed in such a manner that the absorbance of the highest absorption peak in visible absorption spectra exhibited by the metallophthalocyanines in tetrahydrofuran (hereinafter, referred to as "THF") is 5 or more times, preferably 10 or more times, particularly preferably 20 or more times as high as that before the mixing (hereinafter, this mixing step is referred to as "phthalocyanine treatment step"), the dispersibility of a colorant is dramatically improved.

The phenomenon in which the absorbance increases owing to the phthalocyanine treatment step means that the coordination of a polymer ligand to metallophthalocyanines, that are poorly soluble in THF, results in the formation of a polymer complex and makes the metallophthalocyanines soluble in THF. In other words, the phenomenon shows the state of the polymer complex formation.

The dispersibility of a colorant in toner particles is significantly improved by performing the phthalocyanine treatment step in which metallophthalocyanines to be used in the present invention are mixed with a polymerizable monomer represented by any one of the above structural formulae (1) to (3) and/or a polymer ligand containing a base unit derived from the polymerizable monomer in such a manner that the absorbance of the highest absorption peak in visible absorption spectra expressed by the metallophthalocyanines is 5 or more times, preferably 15 or more times, particularly preferably 20 or more times as high as that before the mixing. In addition, the toner performance is dramatically enhanced because uniform chargeability can be given to the whole toner particles at the same time.

In the present invention, a difference between the absorbance of the highest absorption peak in visible absorption spectra expressed by the metallophthalocyanines before the phthalocyanine treatment step and that after the phthalocyanine treatment step is measured according to the following method.

That is, a sample before the phthalocyanine treatment step and a sample after the phthalocyanine treatment step are prepared, Each sample is diluted with THF and dissolved in THF, and each of the resultant solutions is filtered through a membrane filter (pore size: 0.45 μm). The visible absorption spectra of the resultant sample filtrates are measured with a spectrophotometer, and the absorbance of the highest absorption peak exhibited by metallophthalocyanines is determined. A ratio of the absorbance after the phthalocyanine treatment step to that before the phthalocyanine treatment step is calculated from the results. The highest absorption peak expressed by metallophthalocyanines appears in the range of 650 to 700 nm for Zn phthalocyanine.

In the phthalocyanine treatment step in the present invention, a known method can be used as a method of mixing metallophthalocyanines and a polymerizable monomer represented by any one of the structural formulae (1) to (3) and/or a polymer containing a base unit derived from the polymerizable monomer. Specific examples of the method include: (1) a method in which metallophthalocyanines and a polymerizable monomer and/or a polymer containing a base unit derived from the polymerizable monomer are mixed in a media dispersing unit; and (2) a method in which metallophthalocyanines are finely pulverized in advance, and the resultant finely pulverized products are mixed in a non-media dispersing unit such as a high-speed stirrer.

The former method provides a short mixing time period but poses a problem for handling performance of change in chemicals or the like. The latter method enables extremely easy production of the toner. Although the latter method is ordinarily prone to provide a longer treatment time period than that of the former method, metallophthalocyanines and a polymerizable monomer represented by any one of the above structural formulae (1) to (3) and/or a polymer containing a base unit derived from the polymerizable monomer according to the present invention are mixed to produce a polymer dispersant, so that an extremely short treatment time period can be achieved.

Metallophthalocyanines to be used in the latter method are preliminarily pulverized into products each having a particle diameter of preferably 100 nm or less, more preferably 70 nm or less.

Although a conventionally known production unit can be used as the non-media dispersing unit to be used in the phthalocyanine treatment step, a high-speed stirrer is preferable in consideration of a facility of color changeover and maintainability. Examples of the high-speed stirrer include T. K. Homomixer (manufactured by Tokushu Kika Kogyo Co., Ltd.) and Clear Mix (manufactured by M Technique).

In the phthalocyanine treatment step to be performed in the present invention, a dispersion medium to be used in dispersing the metallophthalocyanines and a polymerizable monomer represented by any one of the structural formulae (1) to (3) and/or a polymer containing a base unit derived from the polymerizable monomer described above is preferably one which promotes the formation of a polymer complex, more preferably one in which the polymer complex is soluble, particularly preferably one in which a polymer complex and a polymer ligand are simultaneously soluble. In addition, in producing toner particles through a polymerization process, it is also preferable to use a polymerizable monomer constituting a binder resin of the toner as a dispersion medium. Specifically, a styrene monomer, a (meth)acrylate monomer, or the like is preferably used.

Mixed with a pre-dispersing composition of polymer ligand, prepared in the phthalocyanine treatment step, which containing metallophthalocyanines and a polymerizable monomer represented by any one of the above structural formulae (1) to (3) and/or a polymer containing a base unit derived from the polymerizable monomer (the pre-dispersing composition contains a polymer complex) are a polymerizable monomer constituting a binder resin and a polymerization initiator. In addition, other materials to be incorporated in toner particles such as a colorant, a wax, a polar resin, and a charge-controlling agent are mixed as required with the pre-dispersing composition. Then, the above materials are uniformly dispersed by a known method to prepare a polymerizable monomer composition. That is, the polymerizable monomer composition in the present invention is prepared by dissolving, mixing, and dispersing at least a polymerizable vinyl monomer, metallophthalocyanines and a polymerizable monomer represented by any one of the above structural formulae (1) to (3) and/or a polymer ligand containing a base unit derived from the polymerizable monomer according to the present invention, and, as required, a colorant, a wax and various additives in a "dispersion treatment step".

The dispersion treatment step may be performed separately from the phthalocyanine treatment step. Alternatively, the dispersion treatment step may be performed in "one step treatment" in which a polymerizable monomer, a colorant, and other toner materials are simultaneously mixed and dispersed in the same step as the phthalocyanine treatment step as long as the formation of a polymer complex is not inhibited.

On preparing a polymerizable monomer composition to be used for producing the dry toner of the present invention, a polymerizable vinyl monomer is used as appropriately mixing polymerizable monomers such as those exemplified above to have a theoretical glass transition temperature (Tg) in the range of 40 to 75° C. In particular, a high Tg is not preferable. This is because, when color toners for forming a full-color image are produced, color mixability of the respective color toners decreases, color reproducibility becomes poor, and transparency of an OHP image decreases.

Specific examples of the polymerization initiator to be used in the production of the dry toner of the present invention include: azo or diazo polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide.

The polymerization initiator usage amount, which is appropriately adjusted in accordance with a target degree of polymerization, is generally 1 to 20 parts by mass with respect to 100 parts by mass of the polymerizable vinyl monomer. Although the type of polymerization initiators to be used slightly varies depending on polymerization processes, one or more is used with reference to a 10-hour half-life temperature.

A known crosslinking agent, chain transfer agent, polymerization inhibitor, or the like may be added to a polymerizable monomer composition according to the present invention in order to control the degree of polymerization. Those additives may be added in advance to the polymerizable monomer composition. Alternatively, those additives may be added as required during a polymerization reaction.

The polymerizable monomer composition prepared in the dispersion treatment step or the one step treatment in the present invention is granulated into fine particles in a "granulation step" by being suspended as oil droplets in an aqueous medium.

Known inorganic and organic dispersants may be used as dispersants when the preparing the aqueous dispersion medium during the polymerization in the method for producing the toner of the present invention. Specific examples of the inorganic dispersants include tricalcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, and alumina. Further, specific examples of the organic dispersants include polyvinyl alcohol, gelatin, methylcellulose, methylhydroxypropylcellulose, ethylcellulose, sodium salts of carboxymethylcellulose, and starch.

Further, commercially available nonion, anion, and cation surfactants may also be used. Examples of the surfactants that may be used include sodium dodecyl sulfate, sodium tetradodecyl sulfate, sodium pentadecyl sulfate, sodium octyl sulfate, sodium oleate, sodium laurate, potassium stearate, and calcium oleate.

In the method for producing the dry toner of the present invention, an inorganic and poorly water-soluble dispersant is preferable. In particular, an acid-soluble, poorly water-soluble, and inorganic dispersant is preferably used from the viewpoint of the ease of production. In preparing an aqueous dispersion medium, the usage amount of the dispersant is preferably 0.2 to 2.0 parts by mass with respect to 100 parts by mass of the polymerizable vinyl monomer. In addition, in the present invention, it is preferable to prepare an aqueous dispersion medium by using 300 to 3,000 parts by mass of water with respect to 100 parts by mass of the polymerizable monomer composition.

In the present invention, in preparing an aqueous dispersion medium in which such a poorly water-soluble and inorganic dispersant as described above is dispersed, a commercially available dispersant may be dispersed as it is. Alternatively, to obtain dispersant particles having fine and uniform particle sizes, an aqueous dispersion medium may be prepared with such a poorly water-soluble and inorganic dispersant as described above produced in a liquid medium such as water under high-speed stirring. For instance, when tricalcium phosphate is used as a dispersant, a preferable dispersant can be obtained by mixing an aqueous solution of sodium phosphate and an aqueous solution of calcium chloride under high-speed stirring to form tricalcium phosphate fine particles.

According to the method for producing a toner as described above, a toner can be easily obtained, which prevents the re-aggregation of a colorant or the migration of the colorant to the toner particle surface which has conventionally taken place along with the progress of a polymerization reaction, which suppresses color development failure attributed to dispersion failure of a colorant such as carbon black or a reduction in frictional charge amount or in frictional charging speed, and the toner produced by the method is excellent in matching with an image forming apparatus.

A polymerizable monomer composition granulated in the granulating step of the present invention is polymerized in a "polymerization step" by a known method to provide polymer particles. Furthermore, the polymer particles are washed and dried in a "post-treatment step" by a known method to produce toner particles. Then, an inorganic fine powder or the like is added to the resultant toner particles in a "preparation step" by a known method to prepare a toner of the present invention.

[A Method for Forming an Image]

Further, a method for forming an image suitably employing the toner of the present invention will be described.

The a method for forming an image used in the present invention includes: a charging step of charging an electrostatic latent image bearing member by externally applying a voltage to a charging member; a latent image forming step of forming an electrostatic latent image on the charged electrostatic latent image bearing member; a developing step of forming a toner image on the electrostatic latent image bearing member by developing the electrostatic latent image with the toner of the present invention; a transferring step of transferring the toner image on the electrostatic latent image bearing member to a transfer material through or without an intermediate transferring member; and a fixing step of forming a fixed image on the transfer material by heat pressure fixing the toner image on the transfer material through a heat pressure means.

According to the method for forming an image used in the present invention, the heat pressure means has characteristic as follows: (I) the heat pressure means is provided with at least a rotary heating member having inside a heating medium and a rotary pressing member which forms a nip portion by being pressed in contact with the rotary heating member, (II) the heat pressure means consumes 0 to 0.025 mg/cm$^2$, based on unit area of the transfer material, of an offset-preventing liquid applied to a contact surface of the rotary heating member with the toner image on the transfer material, and (III) the heat pressure means fixes the toner image on the transfer material under heat and pressure through the rotary heating member and the rotary pressing member while conveying the transfer material within the nip portion.

That is, the toner of the present invention, which is excellent in matching with the image forming apparatus, is suitably used in a method for forming an image as described above including at least a charging step, a latent image forming step, a developing step, a transferring step, and a fixing step.

A preferred example of a method for forming an image, in which the toner of the present invention is used, will be described with reference to a schematic diagram of a full-color image forming apparatus shown in FIG. 1. The image forming method involves: forming toner images of respective different colors in a plurality of image forming portions; and sequentially superimposing the toner images on the same transfer material for transfer to form a multi-color image.

A main body of the full-color image forming apparatus is provided with a first image forming unit Pa, a second image forming unit Pb, a third image forming unit Pc, and a fourth image forming unit Pd. A full-color image is obtained by developing toner images of different colors in the respective image forming units, transferring the toner images on the transfer material conveyed by a transfer material conveying belt 20 as a transfer material bearing member, and fixing the toner images by heat pressing.

Structures of the respective image forming units provided in the image forming apparatus will be described with reference to the first image forming unit Pa, for an example.

The first image forming unit Pa is provided with a photosensitive drum 19*a* having a diameter of 24 mmϕ as an electrostatic latent image bearing member, and the photosensitive drum 19*a* rotates in a direction of an arrow.

A primary charging roller 16*a* as a charging means having a diameter of 12 mmϕ is arranged to be in contact with the surface of the photosensitive drum 19*a*. An electrostatic latent image is formed by laser 14*a* irradiated from an exposure device 13*a* according to an image signal on the uniformly charged photosensitive drum 19*a* by the primary charging roller 16*a*.

A developing device 17*a* includes a developing means for forming a toner image by developing the electrostatic latent image formed on the surface of the photosensitive drum 19*a*. A developing roller 15*a*, having a diameter of 18 mmϕ and carrying on its surface a thin film of a toner of a first color, is arranged to come in contact with the photosensitive drum 19*a* through the thin film of the toner, thereby developing a toner image of the first color.

The toner image of the first color developed on the photosensitive drum 19*a* is transferred onto a surface of a transfer material S, which is conveyed by a belt-form transfer material bearing member 20, by a transfer blade 11*a* as a transferring means. The transfer blade 11*a* is in contact with a back surface of the transfer material bearing member 20 and is capable of applying a transfer bias voltage to the transfer material S on the transfer material bearing member 20 by a bias voltage applying means 12*a*.

Residual toner from transfer on the surface of the photosensitive drum 19*a* after completion of the transfer is removed by a cleaning device 18*a*, and the surface is prepared for the following, continuous electrostatic latent image forming.

The image forming apparatus according to the present invention is provided with four image forming units including the second image forming unit Pb, the third image forming unit Pc, and the fourth image forming unit Pd having the same structure as the first image forming unit Pa and containing different colors of toners in the developing devices. For example, the first image forming unit Pa, the second image forming unit Pb, the third image forming unit Pc, and the fourth image forming unit Pd respectively contain a yellow toner, a magenta toner, a cyan toner, and a black toner. The toner images of the respective colors are sequentially transferred on the transfer material in transfer portions of the respective image forming units. At this time, a desired full-color image is obtained by moving the transfer material while adjusting registration in the step, superimposing the respective color toners on the same transfer material, separating the transfer material S from the transfer material bearing member 20 using a separation charger 21, conveying the transfer material S to a fixing device 23 by a conveying means such as a conveying belt, and fixing in single step.

In FIG. 1, the transfer material bearing member 20 is an endless belt-form member, which moves by a drive roller 80 in a direction of an arrow along with progress of image formation. An inner periphery of the transfer material bearing member 20 is provided with a roller 81 which rotates sympathizing with the belt, a device 82 for eliminating the charge of the belt, and a belt cleaning device 83. Further, a pair of resist rollers 24 is provided to convey the transfer material S inside a transfer material holder to the transfer material bearing member 20.

The above image forming apparatus may also include a transfer means of a transfer roller instead of the transfer blade in contact with the back surface of the transfer material bearing member, or a non-contact charging means such as a corona charger.

Further, a conveying means of conveying the transfer material includes a conveying belt consisting of a Tetron fiber mesh or a conveying belt consisting of a thin dielectric sheet containing as main materials a polyethylene terephthalate resin, a polyimide resin, a urethane resin, or the like from a view of easy processing and durability. However, the conveying means may have a structure including a drum-type conveying means.

According to the above image forming apparatus, a toner image transferred in advance comes in contact with the photosensitive drum carrying a toner image transferred later because the respective color toner images are sequentially transferred on the same transfer material in the transfer portions of the respective image forming units. At this time, if toner particles forming a toner image on the transfer material, on which the previous transfer is completed, are in an unstable charging state, so called "re-transfer phenomenon" occurs. In the re-transfer phenomenon, the toner particles on the transfer material are drawn back to the photosensitive drum on which the toner image is subsequently transferred, which may cause a deterioration of image quality. However, the present invention employs a toner containing specific metallophthalocyanines and a polymer ligand having a base unit derived from a specific polymerizable monomer with an amide group. Therefore, the charging state of the toner carried on the transfer material can be stably maintained to the fixing step, and such image failure can be prevented from occurring.

Hereinafter, the transferring step and the fixing step which can be adopted to the method for forming an image of the present invention will be described specifically.

The transferring step preferably employs a contact transfer system in which the toner image is electrostatically transferred to the transfer material while the electrostatic latent image bearing member such as the photosensitive drum or an intermediate transferring member are brought in contact with the transferring means through the transfer material. A contact pressure of the transferring means on the surface of the photosensitive member is a linear pressure of preferably 2.9 N/m (3 g/cm) or more, more preferably 9.8 to 490 N/m (10 to 500 g/cm). If the linear pressure as the contact pressure is less than 2.9 N/m (3 g/cm), a slip in conveying the transfer material or a transfer failure tends to occur undesirably. Further, an excessive contact pressure causes degradation or toner adhesion of the surface of the photosensitive member, possibly resulting in toner fusing on the surface of the photosensitive member.

A transfer device provided with a transfer roller or a transfer belt is used for a transferring means of the above contact transfer system. The transfer roller consists of at least a metal core and a conductive elastic layer. The conductive elastic layer employs an elastic body of urethane or EPDM containing conductive fine particles such as carbon dispersed and having a volume resistivity of about $10^9$ to $10^{10}$ Ω·cm.

On the other hand, the electrostatic latent image bearing member according to the present invention preferably employs a photosensitive member provided with releasability on a surface thereof. A contact angle with respect to water on the surface of the photosensitive member is 85° or more, more preferably 90° or more.

A means for providing the releasability on the surface of the photosensitive member involves: providing a surface layer mainly consisting of a polymer binder on the surface of the photosensitive member; and (1) using a resin having a low surface energy for constituting the surface layer, (2) dispersing an additive on the surface layer for providing water repellency or lipophilic nature, and (3) dispersing a material, in a powder form and having high releasability, on the surface layer. Specific examples of above methods include: introducing a fluorine-containing group or a silicone-containing group into a resin structure for (1); using an additive such as a surfactant for (2); and using a fluorine-containing compound such as polytetrafluoroethylene, polyvinylidene fluoride, and carbon fluoride for (3).

Through the above methods, the surface of the photosensitive member is provided with the releasability, allowing reduction of the residual toner from transfer and suppression of contamination of the surface of the photosensitive member in printing out multiple pages.

On the other hand, the intermediate transferring member preferably is drum-form or belt-form and has an elastic layer which contains, for example, carbon black, zinc oxide, tin oxide, silicon carbide, or titanium oxide dispersed in a nitrile butadiene rubber or the like on a surface of a support member. Hardness of the elastic layer in the range of 10 to 50° according to "JIS K-6301" allows satisfactory transferability and physical matching with the electrostatic latent image bearing member.

Formation of the surface layer consisting of organic materials and having desired physical properties on the surfaces of the electrostatic latent image bearing member, the intermediate transferring member, and the contact transferring member is generally preferable for satisfactory transferability, durability, or the like according to the contact transfer system. However, such formation has technical problems of easily causing the above problems because if, for example, a toner containing a re-aggregated or the like colorant is used, the surface layer has more affinity with the toner particles compared to the case of using inorganic materials. However, the toner of the present invention contains the colorant uniformly dispersed in the toner particles as described above, allowing prevention of image failure by the residual toner from transfer. Therefore, an effect of the present invention may be further exhibited by using a photosensitive member, an intermediate transferring member, and a contact transferring member containing such organic materials for the method for forming an image, which employs the contact transfer system.

According to the method for forming an image used in the present invention, "heat pressure means" forms a fixed image by fixing under heat and pressure the toner image on the transfer material. In the method for forming an image of present invention; (I) the heat pressure means is provided with at least a rotary heating member having a heating medium and a rotary pressing member forming a nip portion by being pressed in contact with the rotary heating member, (II) the heat pressure means consumes 0 to 0.025 mg/cm$^2$, based on a unit area of the transfer material, of an offset-preventing liquid applied to a contact surface of the rotary heating member with the toner image on the transferring member, and (III) the heat pressure means fixes the toner image on the transfer material under heat and pressure through the rotary heating member and the rotary pressing member while conveying the transfer material within the nip portion.

The "rotary heating member" constituting a part of the heat fixing means provides heat for fixing the toner image on the transfer material. Examples of the rotary heating member, as described later, include: (1) a cylindrical member used for a heat roller-type heat pressure means and having inside thereof a heating medium for providing heat to the toner image therein; (2) a cylindrical heat resistant endless film member used for a film-type heat pressure means, having inside thereof a heating medium fixed to and supported on a support for providing heat to the toner image, and driven to move while being pressed by the heating medium; and (3) a cylindrical heat resistant endless film member used for an electromagnetic induction-type heat pressure means, having a magnetic field generating means inside thereof, and having a heating layer for providing heat to the toner image by generating heat through electromagnetic induction by the action of the magnetic field generating means.

Further, the "rotary pressing member" forms a nip portion by being pressed in contact with the rotary heating member and thereby heat and pressure are provided to the toner image on the transfer material while conveying the transfer material within the nip portion.

According to the image forming method of the present invention, the consumption of the offset preventing liquid applied on a contact surface of the rotary heating member with the toner image on the transfer material is set to 0 to 0.025 mg/cm$^2$ based on a unit area of the transfer material, and more preferably to the level in which the offset preventing liquid is not applied at all. From the above, the problems caused by the offset preventing liquid can be prevented, while use of the toner of the present invention allows maintaining of performance of the heat pressure means for a long period of time and providing excellent fixed image.

The consumption of the offset preventing liquid is measured using a general office recycled paper (ratio of recycled pulp mixed: 70% or more) adapted to maximum paper feed region of the target heat pressure means. The consumption is defined by a value (mg/cm$^2$) obtained by dividing a mass (mg) of the offset preventing liquid consumed while feeding 100 sheets of the recycled papers by total area (cm$^2$) of the recycled papers used.

According to the present invention, the offset preventing liquid used remains liquid from −15 to close to 300° C. and has excellent releasability. Specific examples of the offset preventing liquid include dimethyl silicone oil, modified silicone prepared by replacing a part of a methyl group with another substituent, a mixture of these, and mixtures containing a small amount of a surfactant added. The offset preventing liquid used preferably has a viscosity of 100 to 10,000 cSt.

The offset preventing liquid may be applied to the fixing roller by known methods including: a method of allowing the liquid to soak in a coating felt, a felt pad, a felt roller, a web, a Poreflon rod, or the like and then applying the liquid; and a method of directly applying using an oil pan, a pump roller, or the like.

The suitable heat pressure means used in the method for forming an image of the present invention will be described with reference to drawings.

Figure 2:
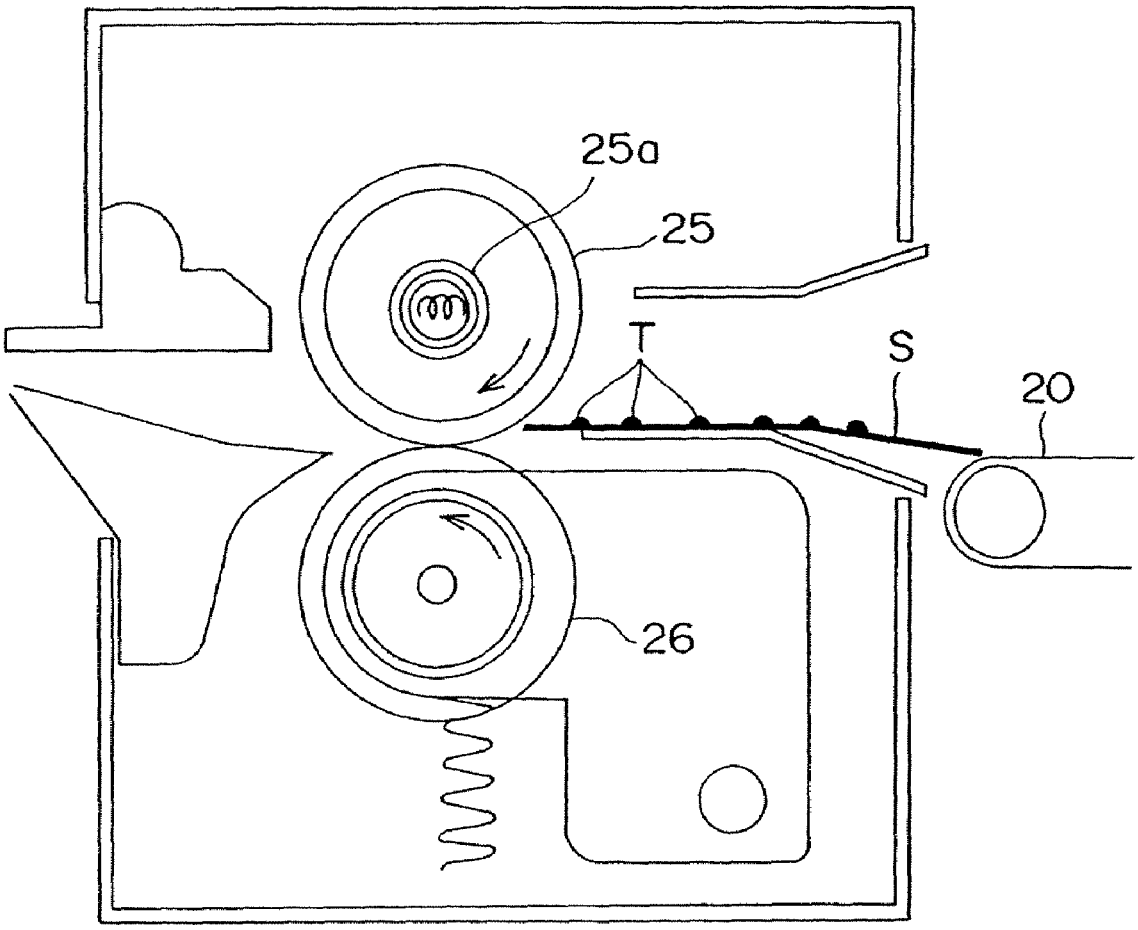
FIG. 2 is a schematic diagram of an example of a heat roller-type heat pressure means preferably used in the present invention.

FIG. 2 is a schematic diagram of an example of a heat roller-type heat pressure means provided with a cylindrical heating roller as the rotary heating member having inside thereof a heating medium, without a cleaning member for removing residual toner from fixing, and without a separating member for preventing winding of the transfer material.

The rotary heating member consisting of a cylindrical heating roller 25 having inside thereof a heating medium such as a heater 25 and a cylindrical pressing roller 26 as the rotary pressing member form a nip portion by being pressed in contact with each other. Both rotate in directions of respective arrows during operation.

A transfer material S as a material to be heated and carrying an unfixed toner T as a toner image is conveyed from the right side as viewed in the drawing (upstream side) by a conveying belt 20. A fixed image is formed on the transfer material S by heat pressing the toner image while conveying the transfer material S within the nip portion between the heating roller 25 and the pressing roller 26. The transfer material S is discharged to the left side as viewed in the drawing (downstream side).

The heating roller 25 used for the heat pressure means according to the present invention has, for example, an aluminum pipe of a thickness of about 2.5 mm as a metal core of which outer peripheral surface is coated with a silicone rubber, a fluorine resin such as Teflon (registered trademark), or the like in a thickness of 200 to 500 μm.

Further, the pressing roller 26 used has, for example, a stainless steel pipe having a diameter of 10 mm as a metal core of which outer peripheral surface is coated with a silicone rubber in a thickness of about 3 mm.

A tubular heater such as a halogen lamp is used for the heater 25*a* provided inside the heating roller 25. The heater 25*a* generates heat by applying a given voltage, and the heating roller 25 is heated by radiant heat therefrom. At this time, the heating roller 25 or the pressing roller 26 pressed in contact therewith is relatively moderately heated. However, heat capacities of the heating roller 25 and the pressing roller 26 are generally large and are heated over a long period of time in many cases. Thus, the heating roller 25 and the pressing roller 26 are easily subjected to thermal degradation. Damages or scratches easily form on the heating roller 25 or the pressing roller 26 particularly when the recycled paper is used or the amount of the offset preventing liquid applied is small. Thus, the thermal degradation is accelerated causing problems from lowering of the releasability of the roller surface. However, using the toner of the present invention reduces load on the above heat pressure means, thereby providing excellent fixed image for a long period of time.

Figure 3A:
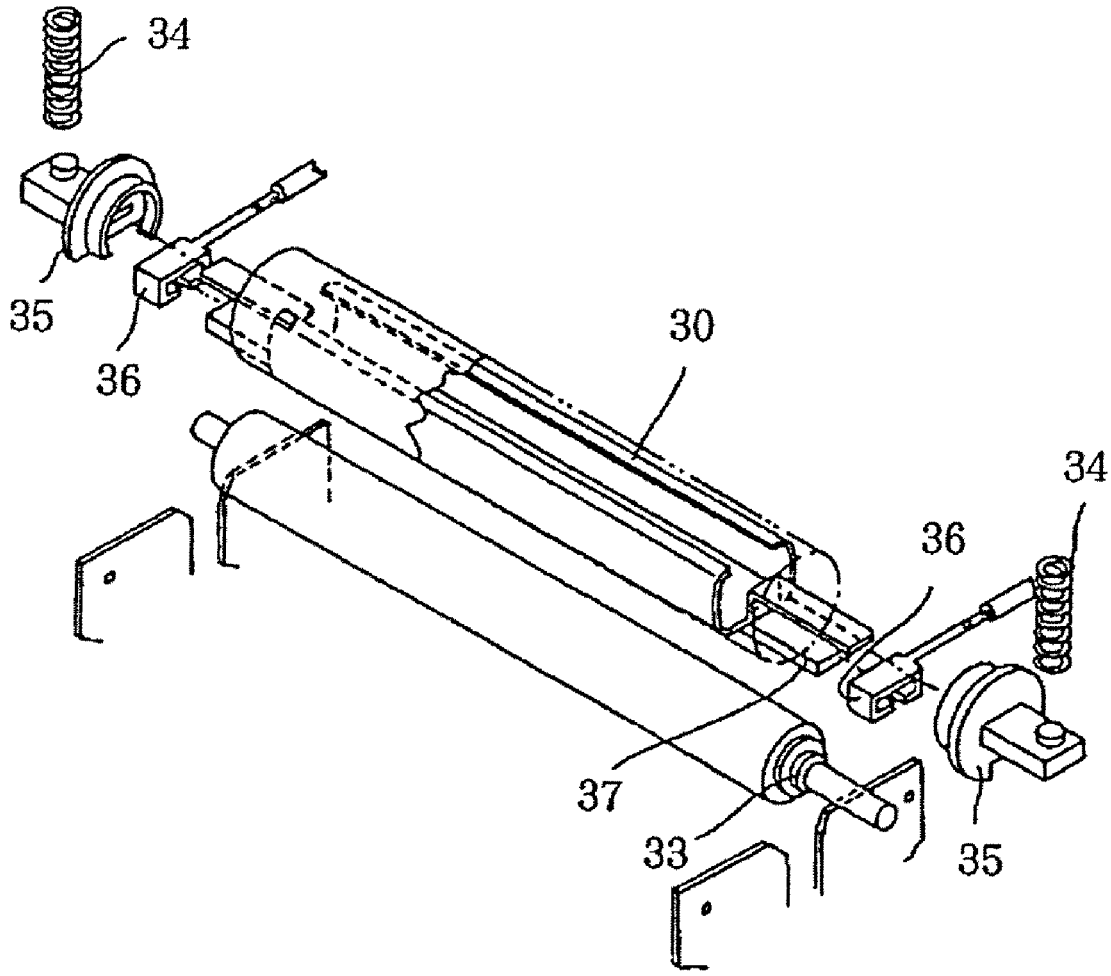
FIG. 3A is an exploded perspective view of a main portion of a film-type heat pressure means preferably used in the present invention.
Figure 3B:
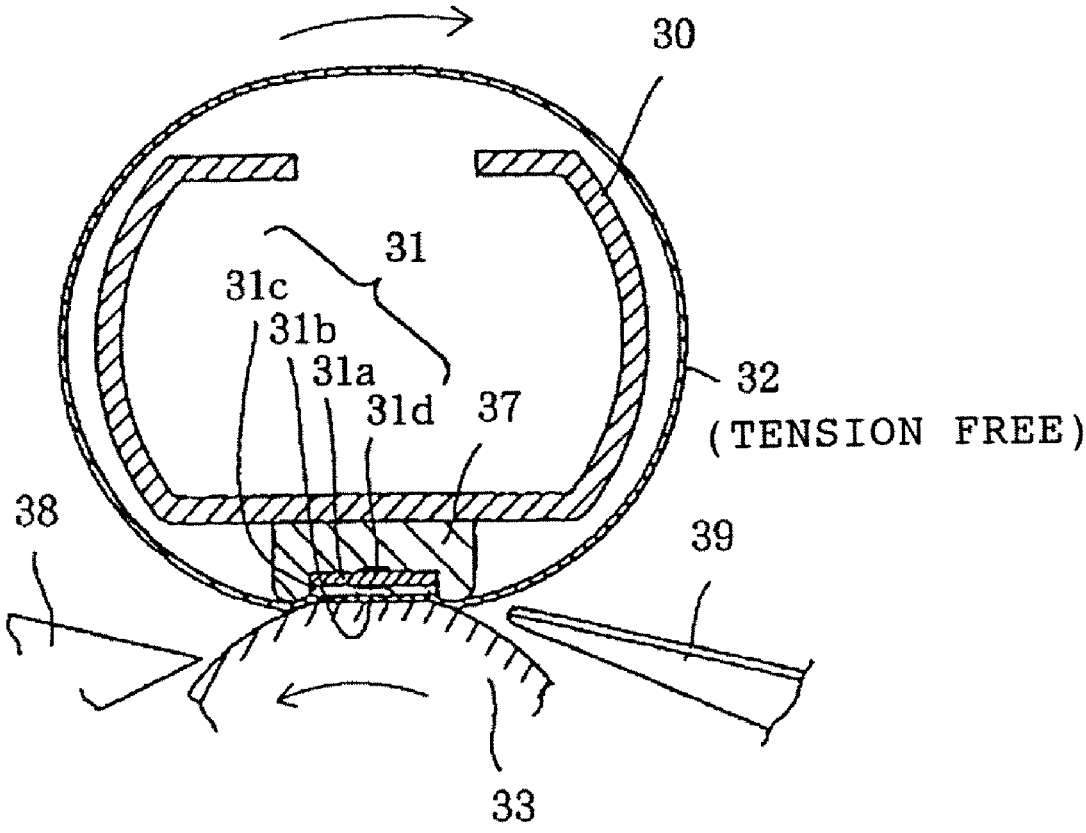
FIG. 3B is an enlarged cross-sectional view of a main portion of a film-type heat pressure means preferably used in the present invention.

FIG. 3A is an exploded perspective view of an example of a film-type heat pressure means: having a heating medium fixed to and supported on a support inside thereof; having a cylindrical heat resistant endless film and driven to move while pressed in contact by the heating medium as a rotary heating member; and fixing the toner image under heat and pressure through the endless film. FIG. 3B is an enlarged cross-sectional view of a main portion of the heat pressure means.

The rotary heating member consisting of a cylindrical heat resistant endless film 32 and having a heating medium 31 fixed to and supported on a support inside thereof and a cylindrical pressing roller 33 as the rotary pressing member form a nip portion by being pressed in contact through the heat resistant endless film 32. In addition, the rotary heating member and the rotary pressing member rotate in the directions of the respective arrows in operation and are pressed against the heating medium 31 by bringing the transfer material, carrying the toner image and as the material to be heated, in close contact with the heat resistant endless film 32, to drive to move the transfer material with the heat resistant endless film 32.

A linear heating medium 31 having a low heat capacity fixed to and supported on the support includes a heater substrate 31*a*, an electrification heat generating resistor (heating element) 31*b*, a surface protective layer 31*c*, and a temperature detector 31*d*.

The heater substrate 31*a* preferably consists of a member exhibiting heat resistance, insulation property, low heat capacity, and high temperature conductivity. An example thereof is an alumina substrate having a thickness of 1 mm, a width of 10 mm, and a length of 240 mm.

The heating element 31*b* is formed by, for example, applying electrically resistant materials such as Ag—Pd (silver-palladium), $Ta_2N$, and $RuO_2$ in a linear or thin-belt form of a thickness of about 10 μm and a width of 1 to 3 mm by screen printing or the like along the length and substantially at a central portion of the bottom surface of the heating substrate 31*a* (side facing film 32). The heating element 31*b* is further coated with about 10 μm of heat resistant glass as the surface protective layer 31*c*.

The temperature detector 31*d* is a low capacity resistance bulb such as a Pt film formed by screen printing or the like substantially at a central portion of the top surface of the heating substrate 31*a* (side opposite to the side provided with the heating element 31*b*), for example. A low heat capacity thermistor or the like can substitute as well.

The heating medium 31 causes the heating element 31*b* to generate heat for substantially an entire length by electrifying the heating element 31*b* at specific timing according to image formation start signals.

The heating element 31*b* is electrified at AC 100V, and power supply is controlled by controlling phase angle of the electrification according to temperature detected by the temperature detector 31*d* by electrification control circuit (not shown) including a triac.

The heating medium 31 has low heat capacity heater substrate 31*a*, heating element 31*b*, and surface protective layer 31*c*. Thus, the surface of the heating medium 31 may be rapidly heated to a desired fixing temperature by electrifying the heating element 31*b* or may be quenched to about room temperature when not in use. The heating medium 31 provides a great thermal shock to the heat resistant endless film 32 or the pressing roller 33 as the rotary pressing member and has releasability. However, the use of the toner of the present invention described above reduces the loads on such heat pressure means and allows provision of excellent fixed image for a long period of time.

The cylindrical heat resistant endless film 32 located between the rotary heating member and the rotary pressing member is preferably a heat resistant sheet composed of a single layer or a composite layer having a thickness of 20 to 100 μm from a view of heat resistance, strength security, durability, and low heat capacity. Preferable examples thereof include: a single layer film of polyimide, polyether imide (PEI), polyether sulfone (PES), a tetrafluoroethylene perfluoroalkyl vinyl ether copolymer resin (PFA), polyether ether ketone (PEEK), and polyparabanic acid (PPA); and a composite layer film such as a polyimide film having a thickness of 20 μm and provided, in a thickness of 10 μm at least on its side coming into contact with the toner image, with a releasable coat layer of a fluorine resin such as a tetrafluoroethylene resin (PTFE), PAF, and FEP or a silicone resin, to which a conductive material such as carbon black, graphite, and conductive whisker are further added.

Further, the pressing roller 33 as the rotary pressing member also serves as a drive roller for driving the heat resistant endless film 32 to move. Thus, the pressing roller 33 preferably not only has excellent releasability to the toner or the like, but also ensures close contact with the heat resistant endless film 32. A rubber elastic body such as a silicone rubber is used, for example. As described above, the great thermal shock is provided to the pressing roller 33, and surface degradation of the pressing roller 33 through long use affects such drive function itself of the heat pressure means. However, the use of the toner of the present invention reduces the loads on such heat pressure means and allows provision of excellent fixed image for a long period of time.

Further, the film-type heat pressure means in FIG. 3 is provided with a stay 30, a coil spring 34, a film end restricting flange 35, a power supply connector 36, a power disruption member 37, an inlet guide 38, and an outlet guide (separation guide) 39.

Figure 4:
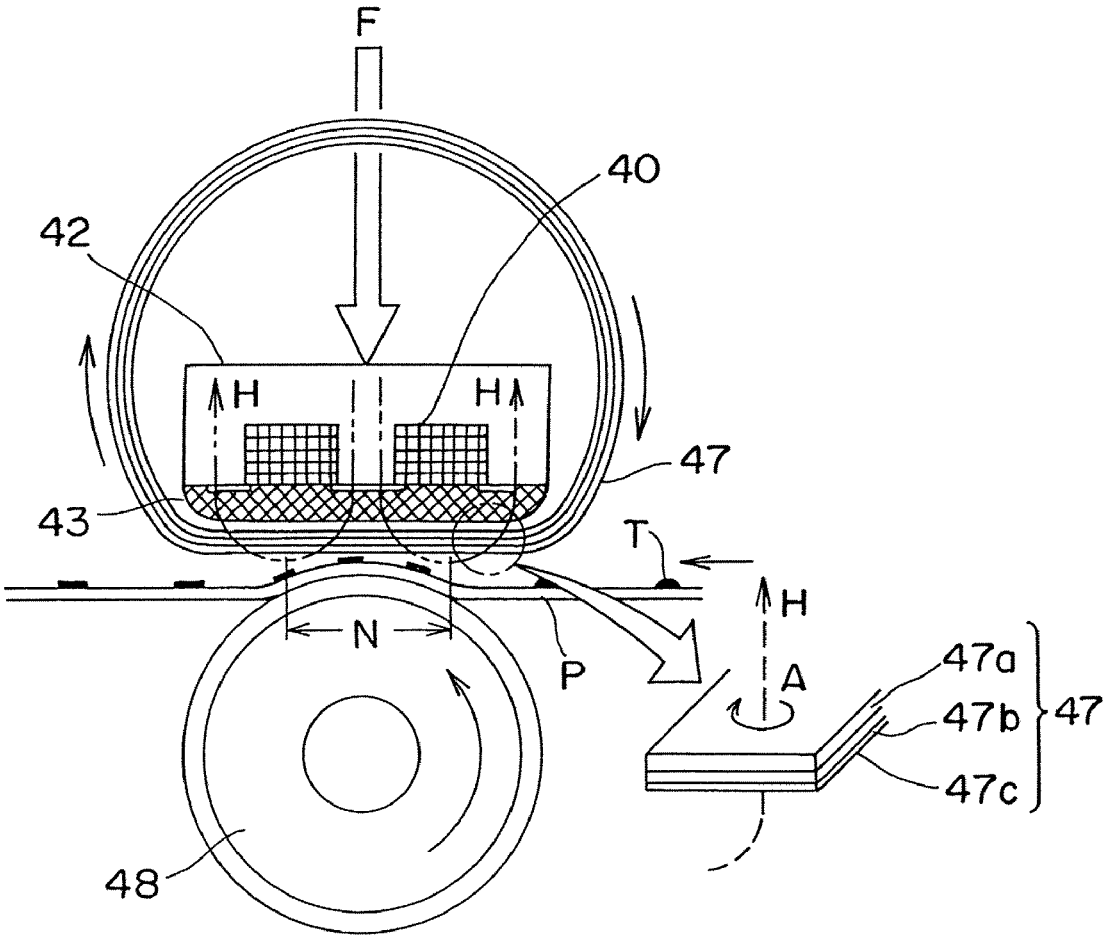
FIG. 4 is a schematic diagram of an example of an electromagnetic induction-type heat pressure means preferably used in the present invention.

Further, FIG. 4 is a schematic diagram of an example of the electromagnetic induction-type heat pressure means provided with the rotary heating member having inside thereof a magnetic field generating means and consisting of a cylindrical heat resistant endless film. The cylindrical heat resistant endless film contains a heating layer which generates heat through electromagnetic induction by the action of the magnetic field generating means.

The heat pressure means includes the magnetic field generating means composed of an exciting coil 40, a coil core (magnetic material) 42 around which the exciting coil 40 is wound, a sliding plate 43 which guides motion of the heat resistant endless film 47 while supporting the exciting coil 40. The heat pressure means is also provided with a rotary heating member composed of the cylindrical heat resistant endless film 47 which is driven to move while being pressed to the magnetic field generating means and the cylindrical pressing roller 48 as the rotary pressing member which is opposite to the heat resistant endless film 47. The heat resistant endless film 47 and the pressing roller 48 are pressed in contact to form a nip portion N, and rotated in the directions of the respective arrows. The transfer material P as a material to be heated carrying the toner image T is brought into close contact with the heat resistant endless film 47 to press against the magnetic field generating means, and the transfer material P is driven to move together with the heat resistant endless film 47.

At this time, in a magnetic field generated by the magnetic field generating means, magnetic flux H represented by arrows around the exciting coil 40 is repeatedly produced and extinguished upon application of alternating electric current of a frequency of 10 to 500 kHz from an excitation circuit (not shown). In a conductive layer (inductive magnetic material) 47*b* in the heat resistant endless film 47 moving within the varying magnetic field, an eddy current A represented by an arrow generates to minimize the variation of the magnetic field by electromagnetic induction. The eddy current is converted into Joule heat by skin resistance of the conductive layer, and thus the conductive layer in the heat resistant endless film 47 serves as the heating layer. As described above, an area around a surface layer of the heat resistant endless film 47 directly generates heat, to thereby achieve rapid heating not dependent on thermal conductivity and heat capacity of the film base layer and even on the thickness of the heat resistant endless film.

A fixed image can be provided on the transfer material P by passing the transfer material P as a material to be heated and carrying the toner image T through the nip portion N in close contact with the heat resistant endless film 47.

A cylindrical heat resistant endless film 47 preferably used in the heat pressure means according to the present invention is composed of at least three layers of a film base layer 47*a*, a conductive layer 47*b*, and a surface layer 47*c*. Examples of the layers include: the film base layer 47*a* of a heat resistant resin such as polyimide having a thickness of 10 to 100 μm; the conductive layer 47*b* on the outer peripheral surface of the film base layer 47*a* (side coming in contact with the material to be heated) formed through treatments such as plating metals of Ni, Cu, Cr, or the like at a thickness of 1.100 μm; and the surface layer 47*c* formed by coating a free surface of the conductive layer 47*b* with a heat resistant resin having a satisfactory toner releasability such as PFA and PTFE independently or in a mixture. Further, the film base layer 47*a* may have a double layer structure to function as a conductive layer as well.

The coil core 42 is formed of, for example, a material having a low remanent flux density and a high magnetic permeability such as ferrite or permalloy. The use of the material having a low remanent flux density for the coil core 42 can control overcurrent generating in the core itself, to thereby increase the efficiency because heat does not generate from the coil core. Further, the use of the material having a high permeability enables the coil core 42 to serve as a path for the magnetic flux H to prevent the magnetic flux from leaking out as possible.

The exciting coil 40 consists of a bundle of plurality of copper thin wires (bundled wires) as lead wires (electric wires) each insulated and coated, which is wound around the core several times. A sheet coil substrate may also be used which is formed by printing an exciting coil pattern in multiple layers on a plane of a substrate made of a nonmagnetic material such as a glass fiber-filled epoxy resin (general-purpose electrical substrate) or ceramic.

The sliding plate 43 is composed of a heat resistant resin such as a liquid crystal polymer or phenyl. A surface of the sliding plate 43 facing the heat resistant endless film 47 is coated with, for example, a resin such as PFA and PTFE or a glass rich in lubricity for reducing frictional resistance with the heat resistant endless film 47.

The pressing roller 48 is composed of a silicone rubber, a fluorine rubber, or the like wound around a periphery of a metal core. The pressing roller 48 is provided by pressing against the bottom surface of the sliding plate 43 through the heat resistant endless film 47 under a given pressing force F by a bearing means and a pressing means (both not shown), and forms the nip portion N while holding the heat-resistant endless film 47 between the pressing roller 48 and the sliding plate 43.

The magnetic field generated by the magnetic force generating means centers around the nip portion N. Thus, an area around a surface layer of the heat resistant endless film 47 generates heat rapidly and directly through electromagnetic induction heating. As a result, the surface of the heat resistant endless film 47 or the pressing roller 48 is provided with great thermal shock, to reduce the releasability to the toner or the like or and the close contact with the heat resistant endless film 47. However, the use of the toner of the present invention reduces the loads on such heat pressure means and allows provision of excellent fixed image for a long period of time.

Hereinafter, the present invention will be further described in detail by way of specific production examples and examples, but the present invention is not in any way limited to those examples.

Table 1 collectively shows specific examples of a polymer used as a polymer ligand or the like in examples and comparative examples.

TABLE 1

| Polymer No. | Content | Tg |
|---|---|---|
| R-1-1 | St-2EHA copolymer containing AMPS (1% by mass) as component | 60° C. |
| R-1-2 | St-2EHA copolymer containing AMPS (5% by mass) as component | 60° C. |
| R-1-3 | St-2EHA copolymer containing AMPS (10% by mass) as component | 65° C. |
| R-1-4 | St-2EHA copolymer containing AMPS (18% by mass) as component | 67° C. |
| R-2 | St-BA copolymer containing AMPS (5% by mass) as component | 70° C. |
| R-3 | St-MB copolymer containing BMAM (10% by mass) as component | 80° C. |
| r-1 | St-MB copolymer containing BMAM (0.3% by mass) as component | 70° C. |
| r-2 | St-MB copolymer containing BMAM (25% by mass) as component | 75° C. |

*Symbols in the table represent the following:
AMPS; 2-acrylamide-2-methylpropanesulfonic acid (polymerizable monomer in the above structural formula (1))
AMPES; 2-acrylamide-2-methylphenyl ethanesulfonic acid (polymerizable monomer in the above structural formula (2))
BMAM; N-butoxymethyl acrylamide (polymerizable monomer in the above structural formula (3))
St; styrene
2EHA; 2-ethylhexylacrylate
BA; n-butylacrylate
MB; monobutyl maleate

PRODUCTION EXAMPLE 1 FOR TONER (Phthalocyanine Treatment Step)

A pre-dispersion (1) was prepared by dispersing a mixture composed of the following components for 2 hours using a media-type disperser (Attritor, beads diameter of 5 mmϕ, manufactured by Mitsui Mining and Smelting Co., Ltd.).

| | |
|---|---|
| Styrene | 83 parts by mass |
| n-Butylacrylate | 17 parts by mass |
| Divinylbenzene | 0.1 parts by mass |
| Zn phthalocyanine (particle diameter of 200 nm) | 0.075 parts by mass |
| Polymer "R-1-3" | 1.5 parts by mass |

Absorbance of the highest absorption peak in visible absorption spectra exhibited by Zn phthalocyanine measured after removing a solid content from the obtained pre-dispersion (1) was increased to 30 times the highest absorption peak in visible absorbance spectra before mixing.

(Dispersion Treatment Step)

7.5 parts by mass of carbon black (particle diameter of 35 nm) as a colorant was added into the pre-dispersion (1), and the mixture was further dispersed for 3 hours. The obtained colorant dispersion product (1) was applied on a developing paper (Super art paper (Kanefuji), available from Seibundo K.K.) using a bar coater (No. 5) and dried. Gloss of a coat surface was 120 measured using a glossimeter (PG-3D, optical sensor of 75°-75°, manufactured by Nippon Denshoku Industries Co., Ltd.), and the coat showed excellent dispersibility of the carbon black.

The obtained colorant dispersion product (1) was warmed to 60° C. A polymerizable monomer composition (1) was prepared by mixing and dissolving 7 parts by mass of an ester wax (polar wax having a melting point of 60° C.) and 5 parts by mass of a paraffin wax (nonpolar wax having a melting point of 110° C.) as waxes and 5 parts by mass of a polyester resin (Tg of 70° C., peak molecular weight of 7,000, and acid value of 30 mgKOH/g) as a polar resin in the colorant dispersion product (1).

(Granulation Step)

700 parts by mass of ion-exchanged water and 800 parts by mass of a 0.1 mol/1-aqueous solution of $Na_3PO_4$ were added to a reaction vessel provided with a high speed stirrer (Clear Mix, manufactured by MTECHNIQUE Co., Ltd.). The stirrer was set to 15,000 rpm, and the mixture was warmed to 60° C. 70 parts by mass of a 1.0 mol/1-aqueous solution of $CaCl_2$ was added to the mixture to prepare an aqueous dispersion medium containing minute hardly water-soluble dispersion stabilizer $Ca_3(PO_4)_2$.

Subsequently, the polymerizable monomer composition (1) containing 5 parts by mass of 2,2'-azobis(2,4-dimethylvaleronitrile) additionally added was added into the aqueous dispersion medium. The mixture was stirred at 60° C. under an $N_2$ atmosphere for 10 minutes while maintaining 15,000 rpm, to thereby suspend the polymerizable monomer composition in the aqueous medium as oil droplets for granulation.

(Polymerization Step)

After that, the stirrer was replaced with a stirrer provided with a paddle stirring blade, and the mixture was maintained at the same temperature for 5 hours while stirring at 100 rpm and then heated to 80° C. A polymerization reaction was completed when polymerization conversion of a polymerizable vinyl monomer substantially reached 100%.

(Post-treatment Step)

After the completion of the polymerization, a volatile component remained in polymer particles was distilled off under heat and reduced pressure. After cooling, the hardly water-soluble dispersant was dissolved by adding diluted hydrochloric acid. Polymer particles (A) were obtained by repeatedly washing with water several times and then drying.

(Preparation Step)

A black toner (A) was obtained by dry mixing 1 part by mass of silicone oil treated-hydrophobic silica fine powder (BET surface area of 200 $m^2/g$) and 0.5 parts by mass of silicone oil treated-hydrophobic titanium oxide fine powder (BET surface area of 45 $m^2/g$) with 100 parts by mass of the polymer particles (A) using a Henschel mixer (manufactured by Mitsui Mining and Smelting Co., Ltd.)

The black toner (A) had a number-average equivalent circle diameter D1 of 4.6 μm, an average circularity of 0.987 and 2.7% by number of toner particles having a circularity less than 0.95 in a frequency distribution of circularity.

PRODUCTION EXAMPLE 2 FOR TONER (One Step Treatment of Phthalocyanine Treatment and Dispersion Treatment)

A colorant dispersion product (2) was prepared in one step by dispersing a mixture composed of the following components for 3 hours using an attritor (manufactured by Mitsui Mining and Smelting Co., Ltd.). In other words, according to the present production example, the colorant dispersion product (2) was prepared in one step treatment collectively conducting the phthalocyanine treatment step and the dispersion treatment step in the "Toner production example 1".

| | |
|---|---|
| Styrene | 83 parts by mass |
| n-Butylacrylate | 17 parts by mass |
| Divinylbenzene | 0.1 parts by mass |
| Carbon black used in "Production example 1" | 7.5 parts by mass |
| Zn phthalocyanine used in "Production example 1" | 0.075 parts by mass |
| Polymer "R-1-3" | 1.5 parts by mass |

Absorbance of the highest absorption peak in visible absorption spectra exhibited by Zn phthalocyanine measured after removing a solid content from the obtained colorant dispersion product (2) was increased to 27 times the highest absorption peak in visible absorbance spectra before mixing. Gloss of a coat surface of the colorant dispersion product (2) was 120, showing satisfactory dispersibility.

Polymer particles (B) were produced following the same procedure as in "Production example 1" except that the obtained colorant dispersion product (2) was used, to thereby obtain a black toner (B).

PRODUCTION EXAMPLE 3 FOR TONER

A colorant dispersion product (3) was prepared in one step following the same procedure as in "Production example 2" except that stirring treatment was conducted at 3,000 rpm for 1 hour using a non-media high speed stirrer (T.K. Homodisper, manufactured by Tokushu Kika Kogyo Co., Ltd.) instead of the attritor in one step treatment of the phthalocyanine treatment step and the dispersion treatment step.

Absorbance of the highest absorption peak in visible absorption spectra exhibited by Zn phthalocyanine measured after removing a solid content from the obtained colorant dispersion product (3) was increased to 3 times the highest absorption peak in visible absorbance spectra before mixing. Gloss of a coat surface of the colorant dispersion product (3) was 50.

Polymer particles (C) were produced following the same procedure as in "Production example 2" except that the obtained colorant dispersion product (3) was used, to thereby obtain a black toner (C).

PRODUCTION EXAMPLE 4 FOR TONER

A colorant dispersion product (4) was prepared in one step following the same procedure as in "Production example 3 for toner" except that Zn phthalocyanine having a particle diameter of 50 nm was used instead of the Zn phthalocyanine (particle diameter of 200 nm) used in "Production example 1".

Absorbance of the highest absorption peak in visible absorption spectra exhibited by Zn phthalocyanine measured after removing a solid content from the obtained colorant dispersion product (4) was increased to 27 times the highest absorption peak in visible absorbance spectra before mixing. Gloss of a coat surface of the colorant dispersion product (4) was 110, showing satisfactory dispersibility of the carbon black.

On the other hand, a production device after producing the colorant dispersion product (4) was in a state allowing a very easy cleaning operation, enabling a quick change of chemicals.

Polymer particles (D) were produced following the same procedure as in "Production example 3" except that the obtained colorant dispersion product (4) was used, to thereby obtain a black toner (D).

PRODUCTION EXAMPLES 5 TO 9 FOR TONER

Colorant dispersion products (5) to (9) were prepared following the same procedure as in "Production example 4" except that kind and amount of Zn phthalocyanine and a polymer used as a polymer ligand were changed respectively as shown in Table 2-1. Polymer particles (E) to (I) were produced from the obtained colorant dispersion products, to thereby obtain black toners (E) to (I).

COMPARATIVE PRODUCTION EXAMPLE 1 FOR TONER

A comparative colorant dispersion product (1) was prepared following the same procedure as in "Production example 4" except that 0.2 parts by mass of the Zn phthalocyanine was used and 10 parts by mass of a polymer "r-1" was used as a polymer ligand. Then, comparative polymer particles (a) were produced, to thereby obtain a comparative black toner (a).

Absorbance of the highest absorption peak in visible absorption spectra exhibited by Zn phthalocyanine measured after removing a solid content from the obtained comparative colorant dispersion product (1) was increased to 1.5 times the highest absorption peak in visible absorbance spectra before mixing. Gloss of a coat surface of the comparative colorant dispersion product (1) was 20, not exhibiting sufficient effect of adding the Zn phthalocyanine and the polymer "r-1" used as a polymer ligand.

COMPARATIVE PRODUCTION EXAMPLE 2 FOR TONER

A comparative colorant dispersion product (2) was prepared following the same procedure as in "Toner production example 4" except that 1 part by mass of a polymer "r-2" was used for a polymer ligand. Then, comparative polymer particles (b) were produced, to thereby obtain a comparative black toner (b).

The comparative black toner (b) had a number-average equivalent circle diameter D1 of 4.4 μm, an average circularity of 0.947 and 32% by number of toner particles having a circularity of less than 0.950 with respect to frequency distribution of a circularity. The polymer "r-2" used as a polymer ligand had adverse effects on formation of toner particles.

COMPARATIVE PRODUCTION EXAMPLE 3 FOR TONER

A comparative colorant dispersion product (3) was prepared by dispersing a mixture composed of the following components for 3 hours using an attritor (manufactured by Mitsui Mining and Smelting Co., Ltd.).

| | |
|---|---|
| Styrene | 83 parts by mass |
| n-Butylacrylate | 17 parts by mass |
| Divinylbenzene | 0.1 parts by mass |
| Carbon black used in "Production example 1" | 7.5 parts by mass |
| Azo Fe compound represented by the following structural formula (7) | 0.25 parts by mass |
| Aluminum di-tert-butylsalicylate compound | 0.5 parts by mass |

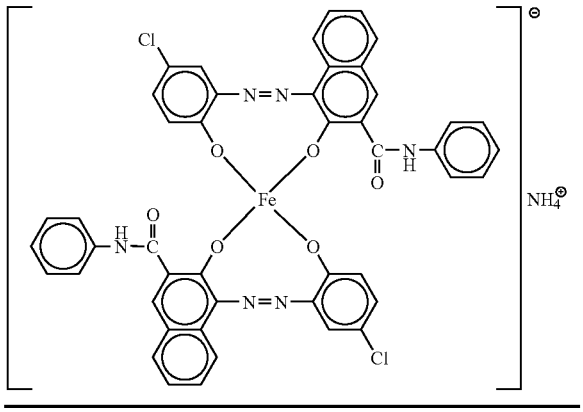

A comparative polymerizable monomer composition (3) was prepared following the same procedure as in "Production example 1" except that the obtained comparative colorant dispersion product (3) was warmed to 60° C., and 12 parts by mass of the ester wax and 5 parts by mass of the polyester resin used in "Production example 1" were mixed and dissolved therein. Then, comparative polymer particles (c) were produced, to thereby obtain a comparative black toner (c).

Gloss of a coat surface of the obtained comparative colorant dispersion product (3) was 30, exhibiting poor dispersibility of the carbon black.

COMPARATIVE PRODUCTION EXAMPLE 4 FOR TONER

A comparative colorant dispersion product (4) was prepared by dispersing a mixture composed of the following components for 3 hours using a sand grinder (manufactured by Igarashi Kikai Seizo).

| | |
|---|---|
| Styrene | 83 parts by mass |
| n -Butylacrylate | 17 parts by mass |
| Divinylbenzene | 0.1 parts by mass |
| Carbon black used in "Production example 1" | 7.5 parts by mass |
| Tetra-n-butyl titanium phthalocyanine | 0.3 parts by mass |
| Aluminum di-tert-butylsalicylate compound | 0.5 parts by mass |
| Polypropylene (PP) wax (nonpolar wax having a melting point of 120° C.) | 5 parts by mass |

A comparative polymerizable monomer composition (4) was prepared following the same procedure as in "Production example 4" except that the obtained comparative colorant dispersion product (4) was used. Then, comparative polymer particles (d) were produced, to thereby obtain a comparative black toner (d).

Gloss of a coat surface of the obtained comparative colorant dispersion product (4) was 70, exhibiting a satisfactory dispersibility of the carbon black. However, re-aggregation of the carbon black was observed in cross-section observation of the obtained comparative black toner (d).

PRODUCTION EXAMPLE 10 FOR TONER

A colorant dispersion product (10) was prepared following the same procedure as in "Production example 4" except that 5 parts by mass of "C.I. Pigment Blue 15:3" was used as a colorant, and amount of Zn phthalocyanine and a polymer ligand added were changed. Then, polymer particles (J) were produced, to thereby obtain a cyan toner (J).

COMPARATIVE PRODUCTION EXAMPLE 5 FOR TONER

A comparative colorant dispersion product (5) was prepared following the same procedure as in "Production example 10" except that a polymer "r-1" was used as a polymer ligand and the amount thereof added was changed. Then, comparative polymer particles (e) were produced, to thereby obtain a comparative black toner (e).

Absorbance of the highest absorption peak in visible absorption spectra exhibited by Zn phthalocyanine measured after removing a solid content from the obtained comparative colorant dispersion product (4) was increased to 1.7 times the highest absorption peak in visible absorbance spectra before mixing. Gloss of a coat surface of the comparative colorant dispersion product (1) was 30, not exhibiting sufficient effect of adding the Zn phthalocyanine and the polymer "r-1" used as a polymer ligand.

COMPARATIVE PRODUCTION EXAMPLE 6 FOR TONER

A comparative colorant dispersion product (6) was prepared following the same procedure as in "Production example 10" except that the Zn phthalocyanine was not added. Then, comparative polymer particles (f) were produced, to thereby obtain a comparative black toner (f).

Gloss of a coat surface of the comparative colorant dispersion product (6) was 40, exhibiting poor dispersibility of the carbon black.

Tables 2-1 and 2-2 show main recipe content such as kind and addition amount of the colorants, Zn phthalocyanine, and polymers as polymer ligands used in the production examples for toner and the comparative production examples toner. Table 3 shows various properties of the obtained toners.

TABLE 2-1

Main recipe content and production method of Toner

| | | Toner recipe | | | | |
|---|---|---|---|---|---|---|
| | Toner No. | Colorant | Amount added (parts by mass) | Metallo-phthalocyanines | Amount added (parts by mass) | Polymer ligand |
| Production example 1 | Black toner (A) | Carbon black Particle diameter of 35 nm | 7.5 | Zn phthalocyanine particle diameter of 200 nm | 0.075 | R-1-3 |
| Production example 2 | Black toner (B) | Carbon black Particle diameter of 35 nm | 7.5 | Zn phthalocyanine particle diameter of 200 nm | 0.075 | R-1-3 |
| Production example 3 | Black toner (C) | Carbon black Particle diameter of 35 nm | 7.5 | Zn phthalocyanine particle diameter of 200 nm | 0.075 | R-1-3 |
| Production example 4 | Black toner (D) | Carbon black Particle diameter of 35 nm | 7.5 | Zn phthalocyanine particle diameter of 50 nm | 0.075 | R-1-3 |
| Production example 5 | Black toner (E) | Carbon black Particle diameter of 35 nm | 7.5 | Zn phthalocyanine particle diameter of 50 nm | 0.1 | R-1-1 |

TABLE 2-1-continued

| Main recipe content and production method of Toner | | | | | | |
|---|---|---|---|---|---|---|
| Production example 6 | Black toner (F) | Carbon black Particle diameter of 35 nm | 7.5 | Zn phthalocyanine particle diameter of 50 nm | 0.125 | R-1-2 |
| Production example 7 | Black toner (G) | Carbon black Particle diameter of 35 nm | 7.5 | Zn phthalocyanine particle diameter of 50 nm | 0.05 | R-1-4 |
| Production example 8 | Black toner (H) | Carbon black Particle diameter of 35 nm | 7.5 | Zn phthalocyanine particle diameter of 50 nm | 0.1 | R-2 |
| Production example 9 | Black toner (I) | Carbon black Particle diameter of 35 nm | 7.5 | Zn phthalocyanine particle diameter of 50 nm | 0.125 | R-3 |

| | Toner recipe | | | Production method | |
|---|---|---|---|---|---|
| | Amount added (parts by mass) | Wax | Amount added (parts by mass) | Phthalo-cyanine treatment | Dispersion treatment |
| Production example 1 | 1.5 | Ester wax (mp = 60° C.) Paraffin wax (mp = 110° C.) | 7 5 | Attritor 2 hours | Attritor 3 hours |
| Production example 2 | 1.5 | Ester wax (mp = 60° C.) Paraffin wax (mp = 110° C.) | 7 5 | Attritor one step treatment 3 hours | |
| Production example 3 | 1.5 | Ester wax (mp = 60° C.) Paraffin wax (mp = 110° C.) | 7 5 | Homodisper one step treatment 1 hour | |
| Production example 4 | 1.5 | Ester wax (mp = 60° C.) Paraffin wax (mp = 110° C.) | 7 5 | Homodisper one step treatment 1 hour | |
| Production example 5 | 10 | Ester wax (mp = 60° C.) Paraffin wax (mp = 110° C.) | 7 5 | Homodisper one step treatment 1 hour | |
| Production example 6 | 2 | Ester wax (mp = 60° C.) Paraffin wax (mp = 110° C.) | 7 5 | Homodisper one step treatment 1 hour | |
| Production example 7 | 1 | Ester wax (mp = 60° C.) Paraffin wax (mp = 110° C.) | 7 5 | Homodisper one step treatment 1 hour | |
| Production example 8 | 3 | Ester wax (mp = 60° C.) Paraffin wax (mp = 110° C.) | 7 5 | Homodisper one step treatment 1 hour | |
| Production example 9 | 1.5 | Ester wax (mp = 60° C.) Paraffin wax (mp = 110° C.) | 7 5 | Homodisper one step treatment 1 hour | |

TABLE 2-2

Main recipe content and production method of Toner

| | Toner No. | Toner recipe | | | | |
|---|---|---|---|---|---|---|
| | | Colorant | Amount added (parts by mass) | Matallo-phthalocyanines | Amount added (parts by mass) | Polymer ligand |
| Comparative production example 1 | Comparative black toner (a) | Carbon black Particle diameter of 35 nm | 7.5 | Zn phthalocyanine particle diameter of 50 nm | 0.2 | r-1 |
| Comparative production example 2 | Comparative black toner (b) | Carbon black Particle diameter of 35 nm | 7.5 | Zn phthalocyanine particle diameter of 50 nm | 0.075 | r-2 |
| Comparative production example 3 | Comparative black toner (c) | Carbon black Particle diameter of 35 nm | 7.5 | (Not added) | 0 | (Not added) |
| Comparative production example 4 | Comparative black toner (d) | Carbon black Particle diameter of 35 nm | 7.5 | Tetra-n-butyl titanium phthalocyanine | 0.3 | (Not added) |
| Production example 10 | Cyan toner (J) | C.I.PB-15:3 | 5 | Zn phthalocyanine particle diameter of 50 nm | 0.1 | R-1-3 |
| Comparative production example 5 | Comparative black toner (e) | C.I.PB-15:3 | 5 | Zn phthalocyanine particle diameter of 50 nm | 0.1 | r-1 |
| Comparative production example 6 | Comparative black toner (f) | C.I.PB-15:3 | 5 | (Not added) | 0 | R-1-3 |

| | Toner recipe | | | Production method | |
|---|---|---|---|---|---|
| | Amount added (parts by mass) | Wax | Amount added (parts by mass) | Phthalo-cyanine treatment | Dispersion treatment |
| Comparative production example 1 | 10 | Ester wax (mp = 60° C.) Paraffin wax (mp = 110° C.) | 7 5 | Homodisper one step treatment 1 hour | |
| Comparative production example 2 | 1 | Ester wax (mp = 60° C.) Paraffin wax (mp = 110° C.) | 7 5 | Homodispar one step treatment 1 hour | |
| Comparative production example 3 | 0 | Ester wax (mp = 60° C.) | 12 | Attritor one step treatment 3 hours | |
| Comparative production example 4 | 0 | PP wax (mp = 120° C.) | 5 | Sand grinder one step treatment 3 hours | |
| Production example 10 | 2 | Ester wax (mp = 60° C.) Paraffin wax | 7 5 | Homodisper one step treatment 1 hour | |
| Comparative production example 5 | 1 | Ester wax (mp = 60° C.) Paraffin wax (mp = 110° C.) | 7 5 | Homodisper one step treatment 1 hour | |
| Comparative production example 6 | 2 | Ester wax (mp = 60° C.) Paraffin wax (mp = 110° C.) | 7 5 | Homodisper one step treatment 1 hour | |

TABLE 3-1

| | | Main production conditions and properties of toner | | | | | |
|---|---|---|---|---|---|---|---|
| | | Toner production conditions | | Toner properties | | | |
| | | | Coat surface | Circle | Circularity frequency distribution | | |
| | Toner No. | Difference of absorption of maximum absorption peak of metallophthalocyanines after treatment | gloss of colorant dispersion product (75°) | equivalent number average diameter (μm) | Average circularity | Circularity standard deviation | Number of toner particles having a circularity of less than 0.950 (number %) |
| Production example 1 | Black toner (A) | 30 times | 120 | 4.6 | 0.987 | 0.019 | 2.7 |
| Production example 2 | Black toner (B) | 27 times | 120 | 4.6 | 0.985 | 0.020 | 3.0 |
| Production example 3 | Black toner (C) | 3 times | 50 | 4.8 | 0.980 | 0.022 | 5.0 |
| Production example 4 | Black toner (D) | 27 times | 110 | 4.6 | 0.987 | 0.019 | 2.6 |
| Production example 5 | Black toner (E) | 8 times | 100 | 5.7 | 0.959 | 0.035 | 23 |
| Production example 6 | Black toner (F) | 13 times | 100 | 4.3 | 0.975 | 0.029 | 8.9 |
| Production example 7 | Black toner (G) | 25 times | 85 | 4.6 | 0.971 | 0.030 | 14 |
| Production example 8 | Black toner (H) | 15 times | 100 | 4.9 | 0.970 | 0.031 | 17 |
| Production example 9 | Black toner (I) | 20 times | 110 | 4.5 | 0.972 | 0.031 | 15 |

TABLE 3-2

| | | Main production conditions and properties of toner | | | | | |
|---|---|---|---|---|---|---|---|
| | | Toner production conditions | | Toner properties | | | |
| | | | Coat surface | Circle | Circularity frequency distribution | | |
| | Toner No. | Difference of absorption of maximum absorption peak of metallophthalocyanines after treatment | gloss of colorant dispersion product (75°) | equivalent number average diameter (μm) | Average circularity | Circularity standard deviation | Number of toner particles having a circularity of less than 0.950 (number %) |
| Comparative production example 1 | Comparative black toner (a) | 1.5 times | 20 | 6.2 | 0.956 | 0.038 | 20 |
| Comparative production example 2 | Comparative black toner (b) | 20 times | 90 | 4.4 | 0.947 | 0.040 | 32 |
| Comparative production example 3 | Comparative black toner (c) | — | 30 | 4.9 | 0.979 | 0.025 | 5.7 |
| Comparative production example 4 | Comparative black toner (d) | 1.3 times | 70 | 3.3 | 0.970 | 0.032 | 12 |
| Production example 10 | Cyan toner (J) | 25 times | 95 | 4.5 | 0.984 | 0.021 | 3.6 |
| Comparative production example 5 | Comparative black toner (e) | 1.7 times | 30 | 5.3 | 0.960 | 0.036 | 22 |
| Comparative production example 6 | Comparative black toner (f) | — | 40 | 4.8 | 0.963 | 0.033 | 21 |

EXAMPLE 1

A full-color image forming apparatus shown in FIG. 1 was used as an image forming apparatus. A medium-resistance rubber roller composed of dimethyl silicone rubber with the resistance adjusted by dispersing carbon black was used for a toner bearing member of the process cartridge of the image forming apparatus. The toner bearing member was provided to be in contact with a photosensitive drum, and a rotational peripheral speed of a developing roller surface was set to 140% in the same direction as a rotational drive of the photosensitive drum at a contact portion with the photosensitive drum surface.

Further, a fixing device provided with a heating roller-type heat pressure means shown in FIG. 2 was used, which was not provided with a separation claw or an application means for an offset preventing liquid.

A heating roller used was provided with: an aluminum cylindrical metal core which was primary treated; an elastic layer of dimethyl silicone rubber; a primer layer; and a surface layer of a PFA tube having a thickness of 50 μm. On the other hand, a pressing roller used was provided with: a stainless steel metal core which was primary treated; an elastic layer of dimethyl silicone rubber; a primer layer; and a surface layer of a PFA tube having a thickness of 50 μm.

Further, inside the cylindrical mandrel of the heating roller was provided with a halogen heater as a heating medium, which was adjusted so that surface temperature of the fixing roller became 170° C. during an operation of the heat pressure means. Further, the heating roller and the pressing roller were pressed with a contact pressure of 20 kgf, to thereby form a nip portion of a width of 3 mm.

Figure 5:
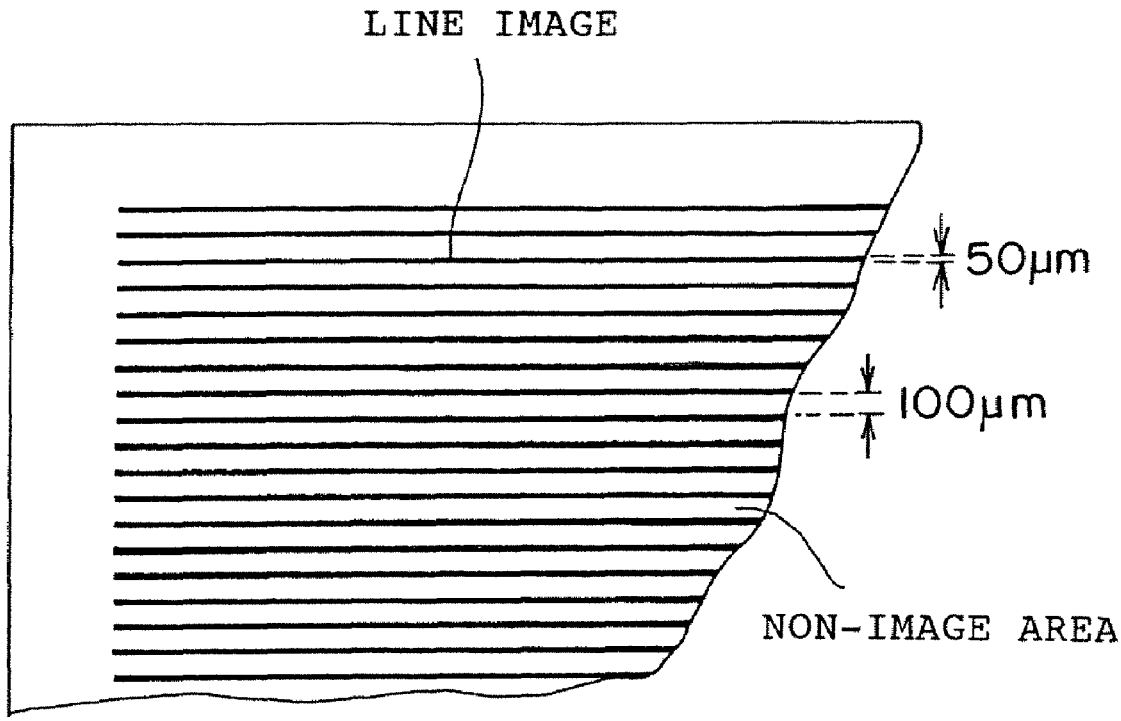
FIG. 5 is a diagram for explaining a line image used in Examples for evaluating reproducibility and fixed state of fine lines.

The black toner (A) obtained in the "Production example 1" was put in to a black color toner cartridge of a fourth image forming unit Pd of the image forming apparatus. Further, 20,000 sheets of line images of fine thin lines as shown in FIG. 5 were printed out at a monochrome mode at a print out speed of 24 sheets (A4 size)/minute using "Recycle paper EN-100" (100% recycled pulp) as a transfer material, to thereby evaluate various printed out images (after 20,000 sheets). Then, the images were continuously printed out up to 200,000 sheets, to thereby evaluate matching of the toner with the image forming apparatus (particularly the heat pressure means) (after 200,000 sheets).

The following describes contents of the evaluation and evaluation criteria for respective items in the printed out image evaluation and the matching evaluation of the toner with the image forming apparatus (particularly the heat pressure means).

<1> Toner Coloring Power

A solid image was formed so that toner amount on a transfer paper was 0.3 to 0.35 mg/cm$^2$ and gloss of an image surface after heat pressure fixing was 20 to 30. A reflection density of the obtained image was measured using "Macbeth reflection densitometer RD918" (manufactured by Gretag-Macbeth LLC). The obtained measured values were evaluated following the evaluation criteria.

A: 1.20 or more
B: 1.05 to less than 1.20
C: 0.90 to less than 1.05
D: less than 0.90

<2> Image Density

A square solid image, 5 mm on a side, was printed out on a transfer paper (75 g/m$^2$), and the reflection density of the printed out image was measured using "Macbeth reflection densitometer RD918" (manufactured by GretagMacbeth LLC). The obtained measured values were evaluated following the evaluation criteria.

A: 1.40 or more
B: 1.35 to less than 1.40
C: 1.00 to less than 1.35
D: less than 1.00

<3> Image Fog

During formation of a solid white image between the developing step to the transfer step, the toner existing on the photosensitive drum was torn off by taping using a myler tape. The reflection density of a clean myler tape on paper with the toner attached was measured using "Macbeth reflection densitometer RD918" (manufactured by Gretag-Macbeth LLC). Values, obtained by subtracting the reflection density of the myler tape on paper from the measured values, were evaluated following the evaluation criteria. The smaller the value, the more the image fog was suppressed.

Figure 6:
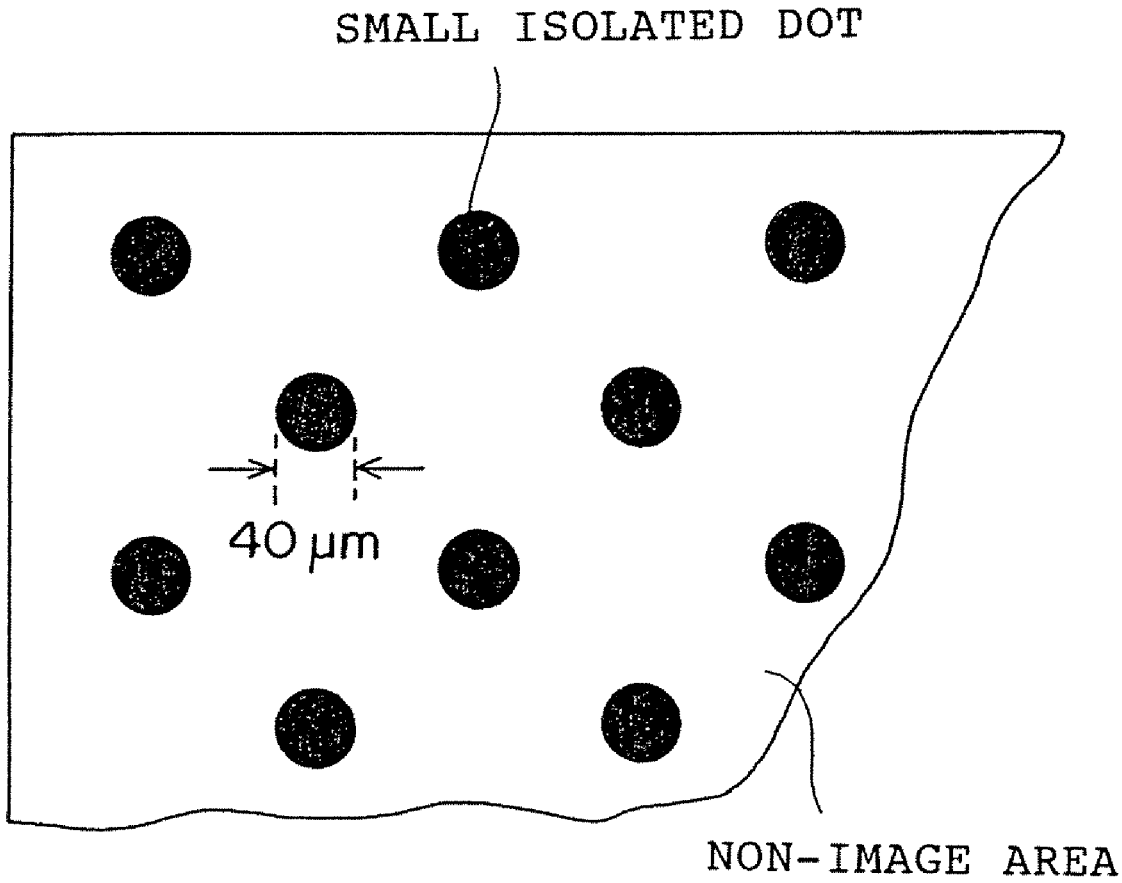
FIG. 6 is a diagram for explaining a small and isolated dot pattern used in Examples for evaluating resolution.

A: less than 0.03
B: 0.03 to less than 0.07
C: 0.07 to less than 1.00
D: 1.00 or more <4> Dot Reproducibility An image of a small (40 μm in diameter) and isolated dot pattern as shown in FIG. 6, of which an electrical field easily closes and is hardly reproduced because of an electrical field of a latent image, were printed out, and dot reproducing conditions at the time were evaluated following the evaluation criteria.

A: 2 or less defects in 100 dots
B: 3 to 5 defects in 100 dots
C: 6 to 10 defects in 100 dots
D: 11 or more defects in 100 dots <5> Incompletion in Solid Image An image with circular images (diameter of 20 mm) arranged in 5 spots was printed out. Spots of incomplete solid images of 100 μm or larger on the image were measured, to thereby evaluate following the evaluation criteria.

A: no formation of incomplete solid images
B: 5 or less spots of incomplete solid images
C: 6 to 10 spots of incomplete solid images
D: 11 or more spots of incomplete solid images <6> Vertical Lines in an Image A halftone image was printed out, and number of vertical lines, which represent unevenness in an image density, on the image were measured, to thereby evaluate following the evaluation criteria.

A: no formation of vertical lines
B: 1 slight image vertical line
C: 2 to 4 lines
D: 5 or more lines <7> Fixability of Thin Line Image A line image consisting of fine thin lines as shown in FIG. 5 was formed on a somewhat thick transfer paper (105 g/m$^2$, A4 size), to thereby evaluate fixing conditions of the image through visual observation or the like following the evaluation criteria.

A: satisfactory fixing condition of thin lines
B: fall of a part of thin lines was observed when strongly rubbing an image surface or slight spot-like toner stain was observed on the printed out image
C: slight offset phenomenon in a non-image portion
D: fall of thin lines or offset phenomenon in places <8> Surface Contamination of Rotary Heating Member After completion of the print out test, a fixing state of the residual toner to the surface of the rotary heating member and an effect thereof on the printed out image were visually observed, to thereby evaluate following the evaluation criteria.

A: no fixing of the toner

B: contamination of the rotary heating member by paper powder or fixing of the toner to end portions of the rotary heating member was observed, but effect on the fixed image was slight.

C: slight toner contamination on the back surface of the printed out image was observed caused by contamination of the rotary heating member by paper powder or fixing of the toner to end portions of the rotary heating member, but effect on the fixed image was hard to observe.

D: effect of the fixed toner on the rotary heating member on the fixed image and winding of the printed out image during the print out test were observed.

The printed out images obtained as described were evaluated to give excellent results in the respective evaluation items. Further, the matching of the toners with the image forming apparatus was excellent as well. Tables 4-1 and 4-2 show the evaluation results.

EXAMPLES 2 TO 9

Examples 2 to 9 were evaluated following the same procedure as in Example 1 except that the black toners (B) to (I) were used respectively instead of the black toner (A). Tables 4-1 and 4-2 show the evaluation results.

COMPARATIVE EXAMPLES 1 TO 4

Comparative Examples 1 to 4 were evaluated following the same procedure as in Example 1 except that the comparative black toners (a) to (d) were used respectively instead of the black toner (A). The obtained printed out images were not only poor in image density or dot reproducibility, but some also resulted in incomplete solid images or image defects of vertical lines ascribable to fixing of the toner on the developing roller. Tables 4-1 and 4-2 show the evaluation results.

EXAMPLE 10

Example 10 was evaluated following the same procedure as in Example 1 except that the cyan toner (J) was put into a cyan toner cartridge of a third image forming unit Pc of the image forming apparatus used in Example 1. Tables 4-1 and 4-2 show the evaluation results.

COMPARATIVE EXAMPLES 5 AND 6

Comparative Examples 5 and 6 were evaluated following the same procedure as in Example 10 except that the comparative cyan toners (e) and (f) were respectively used instead of the cyan toner (J). Tables 4-1 and 4-2 show the evaluation results.

TABLE 4-1

Table of evaluation results

| | | | Printed out image evaluation | | | | | | | | |
|---|---|---|---|---|---|---|---|---|---|---|---|
| | | | Under normal temperature and normal humidity environment | | | | Under high temperature and high humidity environment | | | | |
| | Toner No. | Toner coloring power | Image density | Fog | Dot reproducibility | Incompletion in solid image | Image density | Fog | Dot reproducibility | Incompletion in solid image | Vertical lines |
| Example 1 | Black toner (A) | A | A | A | A | A | A | A | A | A | A |
| Example 2 | Black toner (B) | A | A | A | A | A | A | A | A | A | A |
| Example 3 | Black toner (C) | C | B | B | B | B | B | C | C | C | B |
| Example 4 | Black toner (D) | A | A | A | A | A | A | A | A | A | A |
| Example 5 | Black toner (E) | B | A | B | B | B | C | B | B | B | C |
| Example 6 | Black toner (F) | B | A | A | B | B | B | B | B | B | B |
| Example 7 | Black toner (G) | A | A | A | A | A | B | C | B | C | C |
| Example 8 | Black toner (H) | B | A | A | A | A | A | B | B | B | C |
| Example 9 | Black toner (I) | A | A | A | A | A | B | A | B | B | C |
| Comparative example 1 | Comparative black toner (a) | D | C | C | C | C | C | C | D | C | D |
| Comparative example 2 | Comparative black toner (b) | B | C | B | C | C | D | D | C | D | D |
| Comparative example 3 | Comparative black toner (c) | C | B | B | B | B | C | C | C | C | D |
| Comparative example 4 | Comparative black toner (d) | C | B | C | C | D | D | D | D | D | D |
| Example 10 | Cyan toner (J) | A | A | A | A | A | A | A | A | A | A |
| Comparative example 5 | Comparative black toner (e) | D | B | C | C | C | D | D | D | D | D |
| Comparative example 6 | Comparative black toner (f) | C | B | B | C | B | C | B | C | C | D |

TABLE 4-2

Table of evaluation results

| | Toner No. | Matching with fixing device: Thin line fixability | Matching with fixing device: Surface contamination of rotary heating member |
|---|---|---|---|
| Example 1 | Black toner (A) | A | A |
| Example 2 | Black toner (B) | A | A |
| Example 3 | Black toner (C) | C | B |
| Example 4 | Black toner (D) | A | A |
| Example 5 | Black toner (E) | B | B |
| Example 6 | Black toner (F) | B | B |
| Example 7 | Black toner (G) | A | A |
| Example 8 | Black toner (H) | B | B |
| Example 9 | Black toner (I) | A | A |
| Comparative example 1 | Comparative black toner (a) | D | D |
| Comparative example 2 | Comparative black toner (b) | C | D |
| Comparative example 3 | Comparative black toner (c) | C | C |
| Comparative example 4 | Comparative black toner (d) | C | D |
| Example 10 | Cyan toner (J) | A | A |
| Comparative example 5 | Comparative black toner (e) | D | D |
| Comparative example 6 | Comparative black toner (f) | C | D |

EXAMPLE 11

The fixing device of the image forming apparatus used in Example 1 was replaced by a film-type heat pressure means as shown in FIG. 3, which was not provided with a separation claw or an application means for an offset preventing liquid.

A heat resistant endless film used was a polyimide film of a thickness of 60 μm having a low-resistance release layer, consist of polytetrafluoroethylene (PTFE) containing conductive substances dispersed, at a contact surface with the transfer material. A pressing roller used was provided with: a stainless steel metal core (manufactured by SUS Co., Ltd.) which was primary treated; an elastic layer of a dimethyl silicone rubber foam; a primer layer; and a surface layer of a PTFE tube having a thickness of 20 μm.

Further, inside the heat resistant endless film was arranged with a low heat capacity linear heating medium containing a heating medium prepared by screen-printing a heat generating resistor on a heater substrate and provided with a heat resistant surface protection layer. The surface temperature of the fixing roller was adjusted to 170° C. during an operation of the heat pressure means. Further, the heating medium and the pressing roller were pressed with a contact pressure of 98 N (10 kgf) through the heat resistant endless film, to thereby form a nip portion of a width of 5 mm.

A process cartridge of the image forming apparatus was charged with the toner (G) obtained through the "Production example 7". A print out test was conducted similar as in Example 1 at a print out speed of 12 sheets (A4 size)/minute, to thereby evaluate the matching of the obtained printed out image with the image forming apparatus provided with the heat pressure means or the like. As a result, satisfactory results were obtained.

EXAMPLE 12

The fixing device of the image forming apparatus used in Example 1 was replaced by an electromagnetic induction-type heat pressure means as shown in FIG. 4, which was not provided with a separation claw or an application means for an offset preventing liquid.

A heat resistant endless film had a 3 layer structure consisting of: a resistor layer which generates heat through electromagnetic induction using a cylindrical nickel film of a thickness of 50 μm; and an elastic layer composed of dimethyl silicone rubber and a release layer composed of PFA on an outer peripheral surface of the resistor layer. On the other hand, a pressing roller used was provided with: a stainless steel metal core (manufactured by SUS Co., Ltd.) which was primary treated; an elastic layer of a dimethyl silicone rubber foam; a primer layer; and a surface layer of a PFA tube having a thickness of 50 μm.

Further, inside the cylindrical heat resistant endless film was provided with magnetic field generating means and the surface temperature of the heat resistant endless film was set to 180° C. during an operation of the heat pressure means. Further, the magnetic field generating means and the pressing roller were pressed with a contact pressure of 245 N (25 kgf) through the heat resistant endless film, to thereby form a nip portion of a width of 6 mm.

The toner (G) obtained through the "production example 7" was put into a process cartridge of the image forming apparatus. A print out test was conducted similar to Example 1 at a monochrome mode at a print out speed of 12 sheets (A4 size)/minute, to thereby evaluate the matching of the obtained printed out image with the image forming apparatus (particularly the heat pressure). As a result, satisfactory results were obtained.

EXAMPLE 13

A print out test of graphic images was conducted at a full-color mode by replacing a toner inside a cyan toner cartridge of a commercially available full-color laser printer ("LBP-2510, manufactured by Canon Inc.) with the cyan toner (C) and by using the recycled paper "Recycle paper EN-100" and a transparency film ("OHP film CG3700", available from SUMITOMO 3M Ltd.).

The obtained graphic images were excellent in color reproduction of secondary color involving the cyan color toner such as green color or blue color. Color gamut of the secondary color involving the cyan color toner such as green color and blue color were extended particularly when a full-color image formed on the transparent sheet was displayed as projected images on a white screen using an overhead projector.

As described above, the present invention provides a toner with a significantly improved dispersion state of the colorant in the toner particles by incorporating specific metallophthalocyanines and specific polymer ligands capable of coordinating with the metallophthalocyanine in the toner. As a result, a high-resolution and high-definition image can be acquired which expresses unprecedentedly high coloring power.

Further, the toner of the present invention is capable of being applied to various transfer materials and is capable of maintaining a satisfactory state without impairing performance of the image forming apparatus provided with a heat pressure fixing device or the like for a long period of time.

This invention being thus described, it will be obvious that same may be varied in various ways. Such variations are not to be regarded as departure from the spirit and scope of the invention, and all such modifications would be obvious for one skilled in the art intended to be included within the scope of the following claims.

What is claimed is:

1. A method for forming an image comprising the steps of:

charging an electrostatic latent image bearing member by externally applying a voltage to a charging member;

forming an electrostatic latent image on the charged electrostatic latent image bearing member;

developing the electrostatic latent image with a toner to form a toner image on the electrostatic latent image bearing member;

transferring the toner image on the electrostatic latent image bearing member to a transfer material through or without an intermediate transferring member; and fixing the toner image on the transfer material through a heat pressure means to form a fixed image on the transfer material, wherein:

(I) the heat pressure means is provided with a rotary heating member having a heating medium and a rotary pressing member forming a nip portion in press contact with the rotary heating member, (II) the heat pressure means consumes 0 to 0.025 mg/cm$^2$, based on a unit area of the transfer material, of an offset preventing liquid applied to a contact surface of the rotary heating member with the toner image on the transfer material, and (III) the heat pressure means fixes the toner image on the transfer material under heat and pressure through the rotary heating member and the rotary pressing member while nipping and conveying the transfer material within the nip portion; and the toner is a dry toner comprising: (i) a binder resin; (ii) a colorant; (iii) at least one of metallophthalocyanine and a metallophthalocyanine derivative having a central metal selected from the group consisting of Cr, Fe, Co, Ni, Zn, Mn, Mg, and Al and (iv) at least one of (a) a polymer containing 0.5 to 20% by mass of a base unit derived from a polymerizable monomer represented by the following structural formula (1), (b) a polymer containing 0.5 to 20% by mass of a base unit derived from a polymerizable monomer represented by the following structural formula (2), and (c) a polymer containing 0.5 to 20% by mass each of a base unit derived from a polymerizable monomer represented by the following structural formula (3) and a vinyl monomer having a carboxyl group:

(1)

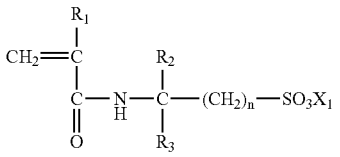

(wherein, $R_1$ represents a hydrogen atom or a methyl group; $R_2$ and $R_3$ each represent independently a hydrogen atom, an aryl group, a $C_1$ to $C_{10}$ alkyl group, a $C_1$ to $C_{10}$ alkenyl group, or a $C_1$ to $C_{10}$ alkoxy group; $X_1$ represents a hydrogen atom, an alkali metal atom, an alkaline earth metal atom, or a quaternary ammonium salt; and n represents an integer of 1 to 10)

(2)

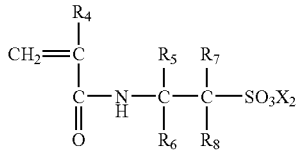

(wherein, $R_4$ represents a hydrogen atom or a methyl group; $R_5$ to $R_8$ each represent independently a hydrogen atom, an aryl group, an aromatic group, a $C_1$ to $C_{10}$ alkyl group, a $C_1$ to $C_{10}$ alkenyl group, or a $C_1$ to $C_{10}$ alkoxy group but at least one of $R_5$ to $R_8$ represents an unsubstituted or substituted aromatic group; and $X_2$ represents a hydrogen atom, an alkali metal atom, an alkaline earth metal atom, or a quaternary ammonium salt)

(3)

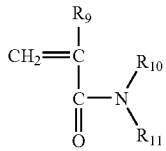

(wherein, $R_9$ represents a hydrogen atom or a methyl group; $R_{10}$ and $R_{11}$ each represent independently a hydrogen atom, an aryl group, a $C_1$ to $C_{20}$ alkyl group, a $C_1$ to $C_{20}$ alkenyl group, or a $C_1$ to $C_{20}$ alkoxy group and $R_{10}$ and $R_{11}$ may be coupled together to form a nonaromatic organic group having different atoms except a carbon atom and a cyclic structure of $C_4$ to $C_{20}$).

2. A method for forming an image according to claim 1, wherein the transfer material is a recycled paper having more than 70% by mass of recycled pulp in mixing ratio.

3. A method for forming an image according to claim 1, wherein the colorant comprises carbon black having a particle diameter of 50 nm or less.

4. A method for forming an image according to claim 1, wherein the colorant comprises a cyan colorant selected from the group consisting of a Cu phthalocyanine compound, a derivative thereof, an anthraquinone compound, and a basic dye lake compound.

5. A method for forming an image according to claim 1, wherein the toner further comprises wax comprising a wax having a melting point of 50 to 110° C. and a wax having a melting point of 80 to 140° C.

6. A method for forming an image according to claim 1, wherein:

the toner has a number-average equivalent circle diameter of 2 to 10 μm with respect to a number-basis particle diameter distribution measured by a flow-type particle image measuring device;

the toner has an average circularity of 0.950 to 0.995 and a content of the particles having the circularity of less than 0.950 of 30% by number or less with respect to a frequency distribution of circularity measured by a flow-type particle image measuring device.

* * * * *